US010843065B2

(12) United States Patent
Acton et al.

(10) Patent No.: US 10,843,065 B2
(45) Date of Patent: Nov. 24, 2020

(54) ROULETTE WHEEL APPARATUS

(71) Applicant: TCS John Huxley Europe Limited, London (GB)

(72) Inventors: Steven William Acton, Staffordshire (GB); Peter Skinner, Staffordshire (GB)

(73) Assignee: TCS John Huxley Europe Limited, Stoke-on-Trent (GB)

( * ) Notice: Subject to any disclaimer, the term of this patent is extended or adjusted under 35 U.S.C. 154(b) by 0 days.

(21) Appl. No.: 15/115,421

(22) PCT Filed: Jan. 30, 2015

(86) PCT No.: PCT/GB2015/000039
§ 371 (c)(1),
(2) Date: Jul. 29, 2016

(87) PCT Pub. No.: WO2015/114302
PCT Pub. Date: Aug. 6, 2015

(65) Prior Publication Data

US 2017/0136344 A1 May 18, 2017

(30) Foreign Application Priority Data

Jan. 31, 2014 (GB) ..... 1401775.0

(51) Int. Cl.
*A63F 7/22* (2006.01)
*A63F 5/00* (2006.01)
*A63F 7/26* (2006.01)

(52) U.S. Cl.
CPC ..... *A63F 5/00* (2013.01); *A63F 5/0005* (2013.01); *A63F 7/26* (2013.01)

(58) Field of Classification Search
CPC ..... A63F 5/00; A63F 5/0005
USPC ..... 273/108.31, 113, 119 R, 122 R, 142 E
See application file for complete search history.

(56) References Cited

U.S. PATENT DOCUMENTS 4,337,945 A 7/1982 Levy
4,559,918 A 12/1985 Ballerin et al.
4,632,088 A * 12/1986 Bruce ..... A63B 69/406 124/6
4,906,005 A * 3/1990 Manabe ..... A63F 5/00 273/142 B (Continued)

FOREIGN PATENT DOCUMENTS

EP 0269331 6/1988
EP 1009500 8/1998

(Continued)

OTHER PUBLICATIONS

GB Search Report dated Jul. 3, 2014.

(Continued)

*Primary Examiner* — Joseph B Baldori
(74) *Attorney, Agent, or Firm* — Shumaker & Sieffert, P.A.

(57) ABSTRACT

A roulette wheel apparatus comprising a rotatable roulette wheel located in a wheel bowl and a ball launcher adapted to launch a roulette ball into the wheel bowl with a predetermined variable launch speed, the ball launcher comprising at least one rotatable element adapted to accelerate a roulette ball in contact with the rotatable element and/or at least one element adapted to spin a roulette ball in contact with the element.

26 Claims, 12 Drawing Sheets

(56) References Cited

U.S. PATENT DOCUMENTS

| | | | | |
|---|---|---|---|---|
| 5,827,119 | A * | 10/1998 | Bromley | A63F 5/00 273/142 B |
| 6,083,105 | A * | 7/2000 | Ronin | A63F 5/0005 273/142 E |
| 6,520,845 | B2 | 2/2003 | Hirokawa et al. | |
| 6,520,854 | B1 * | 2/2003 | McNally | A63F 5/00 273/142 B |
| 6,776,732 | B2 * | 8/2004 | Parkinson | A63B 69/406 124/34 |
| 8,517,382 | B1 * | 8/2013 | Pagliuca | G07F 17/3202 273/142 E |
| 2010/0133746 | A1 * | 6/2010 | Dayal | A63F 7/0608 273/108.31 |
| 2011/0223983 | A1 * | 9/2011 | Schwartz | G07F 17/3211 463/17 |
| 2013/0193644 | A1 * | 8/2013 | Dayal | A63F 7/0608 273/317.7 |

FOREIGN PATENT DOCUMENTS

| | | |
|---|---|---|
| GB | 2198047 | 6/1988 |
| GB | 2344540 | 6/2000 |
| JP | 2005305030 | 4/2001 |
| WO | 1999011341 | 3/1999 |
| WO | 2008153505 | 12/2008 |
| WO | 2009093068 | 7/2009 |

OTHER PUBLICATIONS

International Search Report dated May 11, 2015.
Examination Report dated Dec. 2, 2019 for corresponding GB Application No. 1401775.0, 7 pgs.

* cited by examiner

ROULETTE WHEEL APPARATUS

CROSS-REFERENCE TO RELATED APPLICATIONS

This application is a national stage entry under 35 U.S.C. § 371 of International Application No. PCT/GB2015/000039, filed Jan. 30, 2015, which claims the benefit of priority of GB Application No. 1401775.0, filed Jan. 31, 2014, the disclosures of which are hereby incorporated by reference herein in their entirety.

TECHNICAL FIELD

The present invention relates to a roulette wheel apparatus, and in particular to a ball launcher for use in roulette wheel apparatus and roulette wheel apparatus comprising the ball launcher.

BACKGROUND

The real game of roulette is played using a rotating wheel having a plurality of appropriately numbered and coloured slot compartments around its circumference. The wheel and slot compartments are shaped and arranged so that a roulette ball propelled onto the rotating wheel will land in a random one of the slot compartments and be retained in the slot compartment.

Traditionally, the roulette wheel is set rotating manually and the roulette ball is manually propelled onto the rotating wheel by a croupier running a roulette game. Users playing the game place bets of various types based on which of the slot compartments the ball lands in with the croupier, and when the ball has come to rest the croupier pays out any winnings to the users as necessary.

It has previously been proposed to provide an automatic roulette wheel assembly comprising a roulette wheel rotated by a motor, a ball firer to fire a roulette ball onto the rotating wheel so that it will land in a random slot compartment, and a return mechanism to return the ball from the slot in which lands back to the firing mechanism. Such an automatic roulette wheel assembly may be used to provide a game of roulette operated by a croupier taking bets and paying out winnings in a casino.

It has previously been further proposed to provide a fully automatic roulette wheel assembly by providing such an automatic roulette wheel assembly together with means to identify the slot compartment in which the ball lands, and means for users to place bets and receive any winnings. Such a fully automatic roulette wheel assembly may be used to provide a game of roulette without requiring any human operator, either in a casino or remotely, for example with the game being viewed and bets placed by, and winnings paid to, players via an electronic interface and over the Internet.

It is important in the game of roulette that the roulette ball ends its movement by being retained in a random and unpredictable slot compartment, and that the confidence of users that this is the case is maintained. Accordingly, it is desirable that the return mechanism does not noticeably affect the movement of the ball.

It is important in the game of roulette that it is not possible for a user to predict which of the slot compartments the ball will end up being retained by. If it were possible for a user to predict which slot compartment the ball is likely to end up being retained by, even approximately, when placing a bet, this would invalidate the probability calculations underpinning the game and allow that user to reduce or eliminate the house percentage providing profit to the game operator. This is a particular problem if users are allowed to observe the game and place bets remotely, because it is possible for remote users to measure and analyse the movement of the roulette ball in ways which would not be permitted if they were actually present in a casino, for example, the use of a computer using image analysis software to measure ball movement and velocity and predict the likely future ball trajectory. Accordingly, it is desirable to ensure that the slot compartment in which the roulette ball comes to rest is both random and unpredictable.

SUMMARY OF THE INVENTION

In a first aspect, the invention provides a roulette wheel apparatus comprising: a rotatable roulette wheel located in a wheel bowl; and a ball launcher adapted to launch a roulette ball into the wheel bowl with a predetermined variable launch speed; wherein the ball launcher comprises at least one rotatable element adapted to accelerate a roulette ball in contact with the rotatable element.

In a second aspect, the invention provides a roulette wheel apparatus comprising: a rotatable roulette wheel located in a wheel bowl; and a ball launcher adapted to launch a roulette ball into the wheel bowl with a predetermined variable launch spin speed;

wherein the ball launcher comprises at least one element adapted to spin a roulette ball in contact with the element.

In another aspect, the invention provides a roulette wheel apparatus comprising a rotatable roulette wheel having a plurality of roulette ball receiving pockets and located in a wheel bowl; and a ball recovery mechanism adapted to recover a roulette ball from a pocket of the roulette wheel; wherein the pockets of the roulette wheel have no bottoms and a ball supporting surface is provided underneath the roulette wheel, the ball recovery mechanism comprising a moveable member coplanar with the supporting surface and arranged for selective movement between a first position where the moveable member will support a roulette ball located in a pocket and a second position where the moveable member will not support a roulette ball located in a pocket.

In another aspect, the invention provides a ball launcher for a roulette wheel apparatus, the ball launcher being arranged to launch a roulette ball with a predetermined variable launch speed and/or a predetermined variable spin speed.

BRIEF DESCRIPTION OF THE DRAWINGS

Embodiments of the invention will are described by way of example with reference to the accompanying diagrammatic figures, in which.

DETAILED DESCRIPTION

Figure 1:
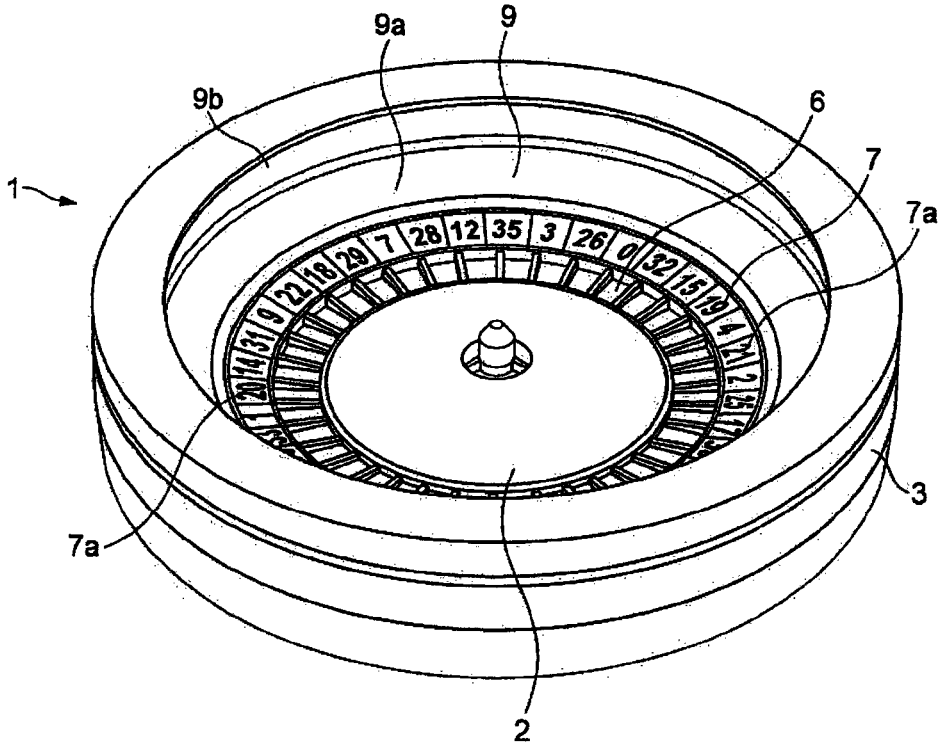
FIG. 1 shows a view from above of a roulette wheel apparatus according to an embodiment of the invention.
Figure 2:
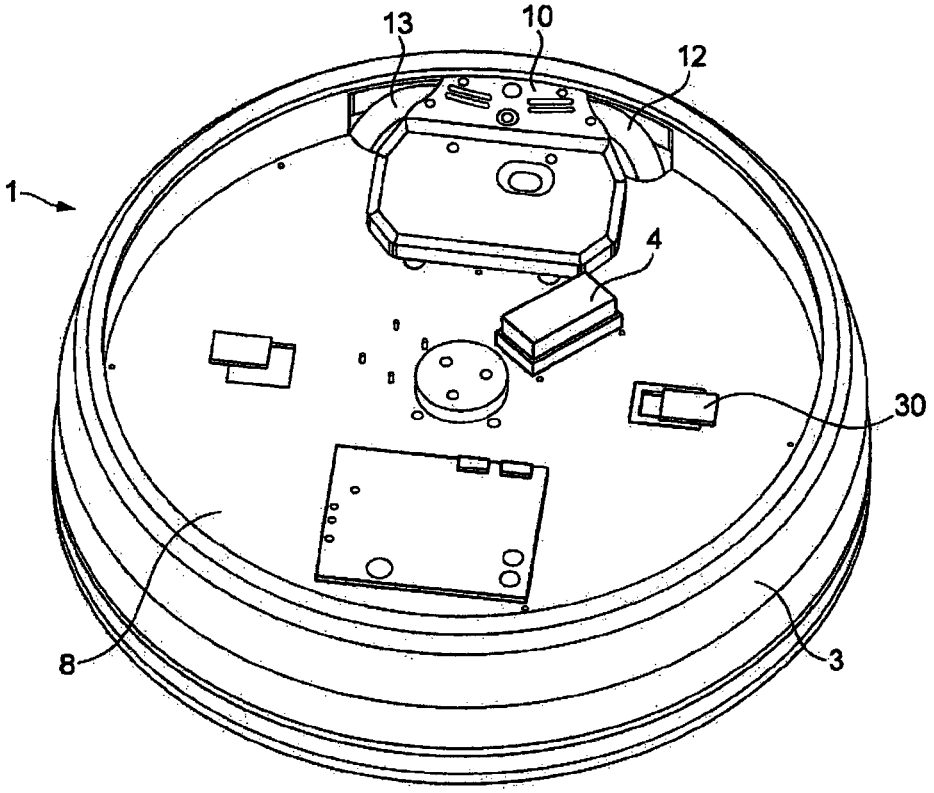
FIG. 2 shows a view from below of the roulette wheel apparatus of FIG. 1.
Figure 3:
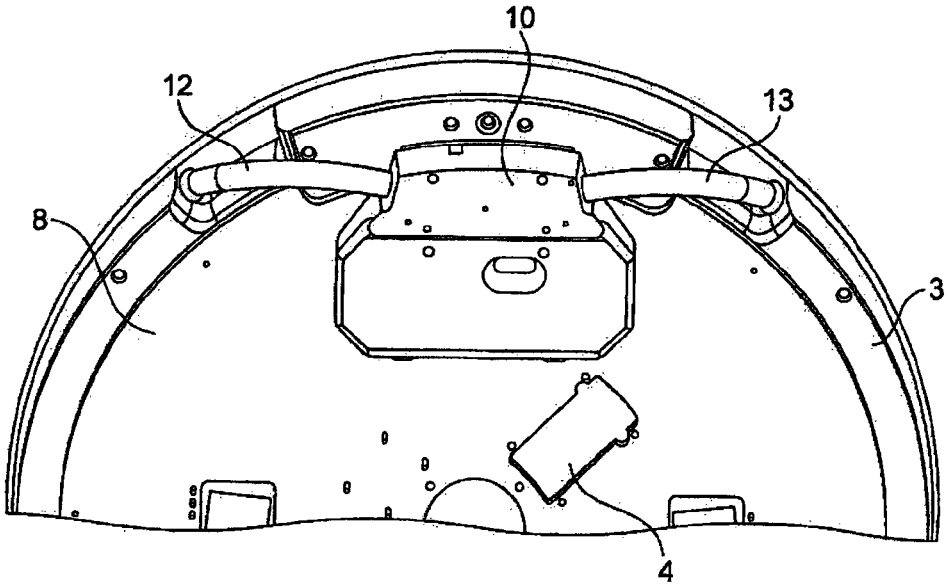
FIG. 3 shows a further view from below of the roulette wheel apparatus of FIG. 1 with some parts removed.
Figure 4:
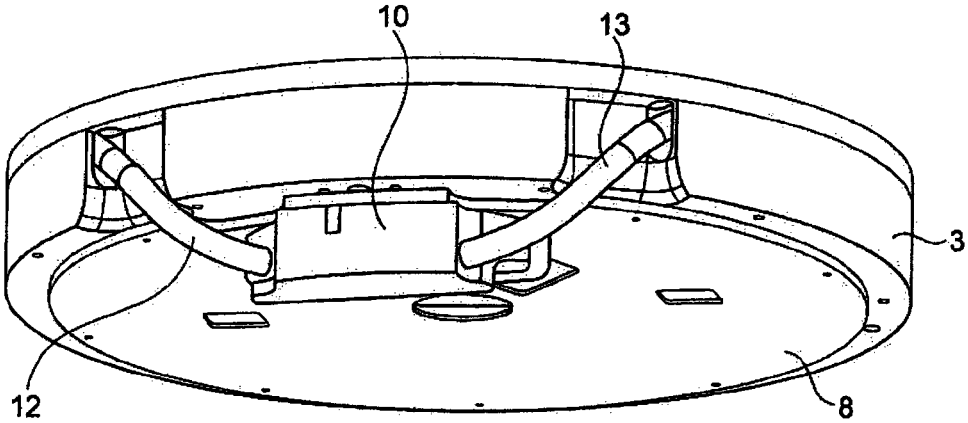
FIG. 4 shows a further view from below of the roulette wheel apparatus of FIG. 1 with some parts removed.
Figure 5:
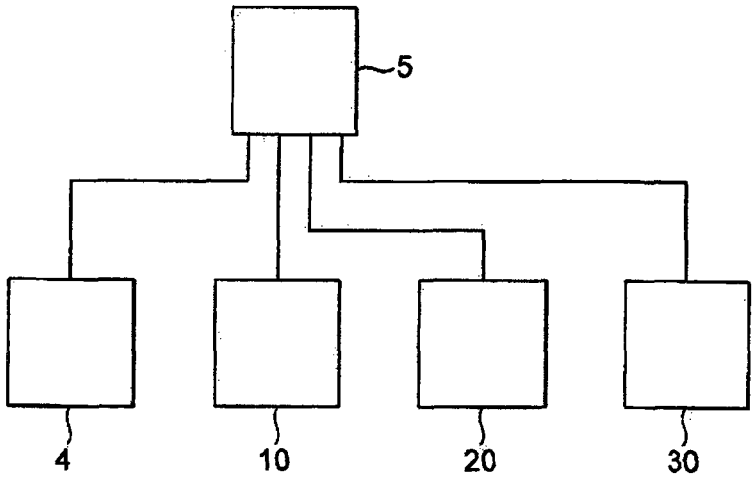
FIG. 5 shows a diagram of the control arrangements of the roulette wheel apparatus of FIG. 1.

FIG. 1 shows a perspective view from above of the general arrangement of a roulette wheel apparatus 1 according to an embodiment of the present invention, while FIGS. 2 to 4 show respective perspective views from below of the general arrangement of the roulette wheel apparatus 1. The views of FIGS. 3 and 4 have some components removed to allow parts of the roulette wheel apparatus 1 which are concealed in FIGS. 1 and 2 to be seen. FIG. 5 shows a schematic diagram of the control arrangements for the different components of the roulette wheel apparatus 1.

The roulette wheel apparatus 1 comprises a roulette wheel 2, or rotor, supported on a wheel base 3, or stator, by one or more bearings so that the roulette wheel 2 is able to rotate relative to the supporting wheel base 3 about a substantially vertical axis of rotation. A drive motor 4 is also mounted on the wheel base 3. The drive motor 4 is arranged to be able to drive the roulette wheel 2 in order to rotate the roulette wheel 2 in either direction relative to the wheel base 3. In some examples the drive motor 4 may drive the roulette wheel 2 directly, while in other examples the drive motor 4 may drive the roulette wheel 2 through a drive mechanism.

The drive motor 4, and where present, the drive mechanism, operate under the control of a control system 5 to rotate the roulette wheel 2 in a selected direction at a selected speed.

In some embodiments the drive motor 4 may be an AC electric motor, or low voltage DC electric motor, a stepper motor, or a compressed air motor. In some examples where a drive mechanism is provided, this may comprise a gearbox.

In some embodiments the roulette wheel 2 may be provided with handles. In such examples the motor 4 and/or drive mechanism may be disengageable so that the handles can be used to manually rotate the roulette wheel 2 instead of the motor 4 being used.

The roulette wheel 2 has a plurality of equally sized and shaped slot compartments 6 arranged circumferentially around the roulette wheel 2. Each slot compartment 6 has a length extending in a radial direction relative to the axis of rotation of the roulette wheel 2 and a width extending circumferentially relative to the axis of rotation of the roulette wheel 2. Each slot compartment 6 has a width which is greater at its radially outer end than at its radially inner end so that the plurality of slot compartments 6 form an annulus. The roulette wheel 2 further comprises a sloped annular surface 7 located around an outer circumferential edge of the roulette wheel 2 so that the sloped annular surface 7 is located radially outwardly from the slot compartments 6. The sloped annular surface 7 is arranged to slope downward in a radially inward direction so that the annular surface 7 tends to direct a roulette ball 100 inwardly towards the slot compartments 6. The annular surface 7 is marked with a plurality of spaced different coloured numbered sectors 7*a* arranged so that each coloured numbered sector 7*a* is adjacent to a corresponding one of the slot compartments 6. The number of slot compartments 6 and coloured numbered sectors 7*a* will depend upon the type of roulette which the roulette wheel 2 is intended to be used to play.

Figure 6:
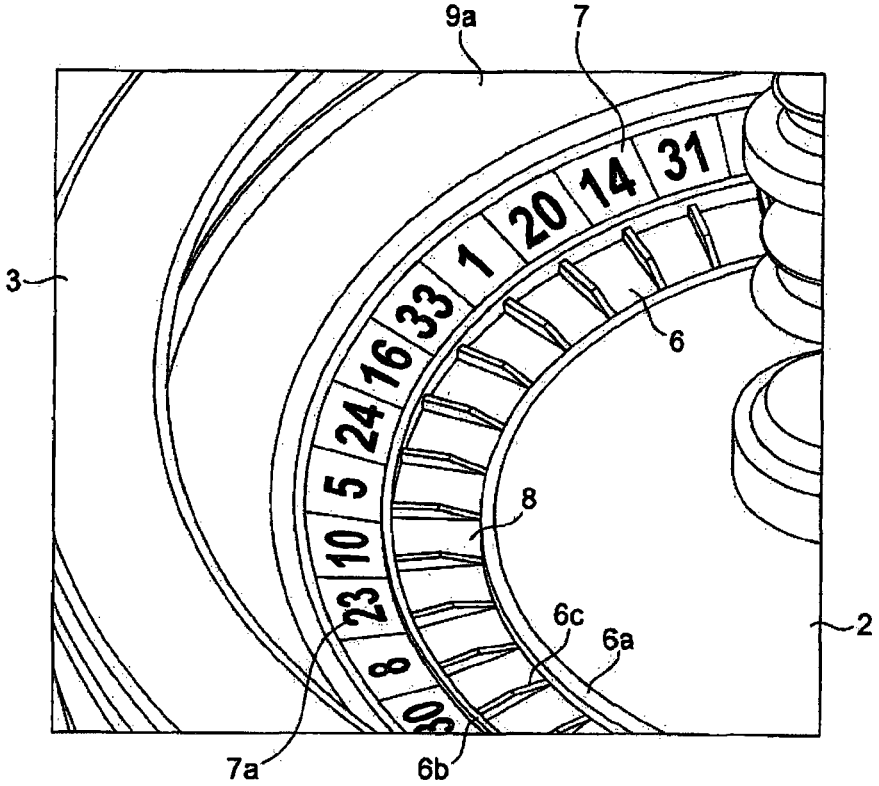
FIG. 6 shows a more detailed view from above of part the roulette wheel apparatus of FIG. 1.

FIG. 6 shows a more detailed view of the roulette wheel 2. As can be seen in FIG. 6, in the illustrated embodiment the slot compartments 6 of the roulette wheel 2 are defined between inner and outer circular walls 6*a* and 6*b* by a plurality of spaced apart sidewalls 6*c*, and the slot compartments 6 have no bottoms. Accordingly, each slot compartment 6 defines an aperture passing entirely through the roulette wheel 2. Each slot compartments 6 is large enough that a roulette ball 100 can pass through the aperture defined by the slot compartment 6.

Figure 7:
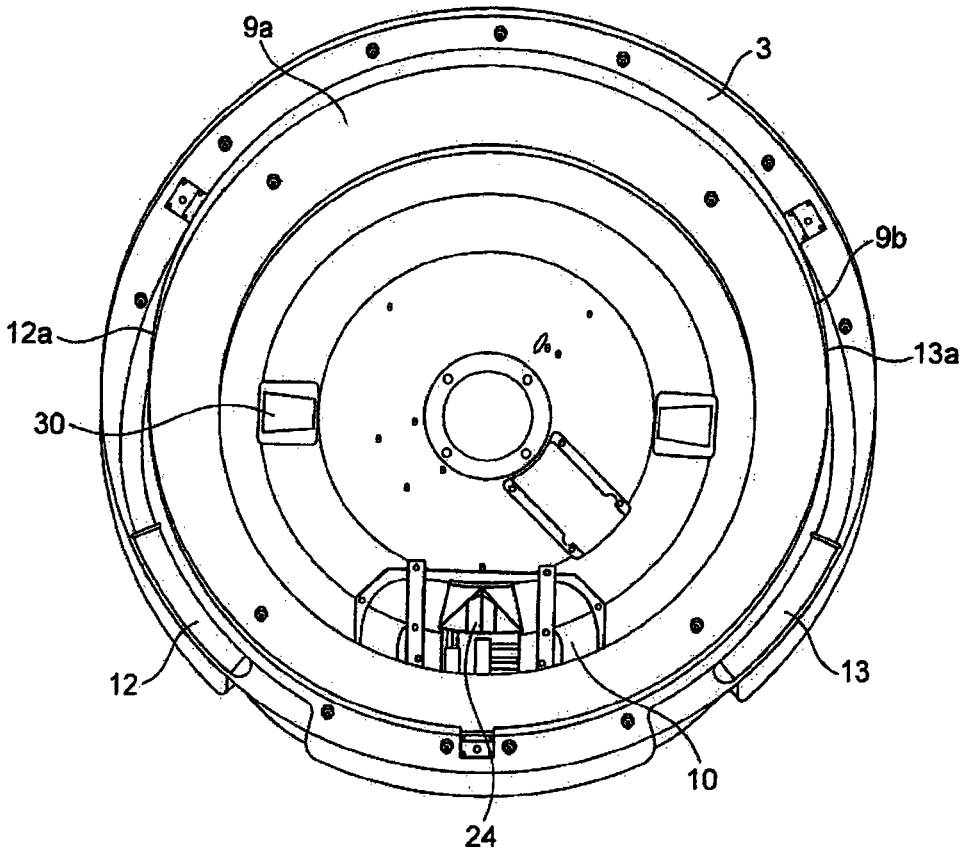
FIG. 7 shows a plan view from above of the roulette wheel apparatus of FIG. 1 with the roulette wheel removed.
Figure 8:
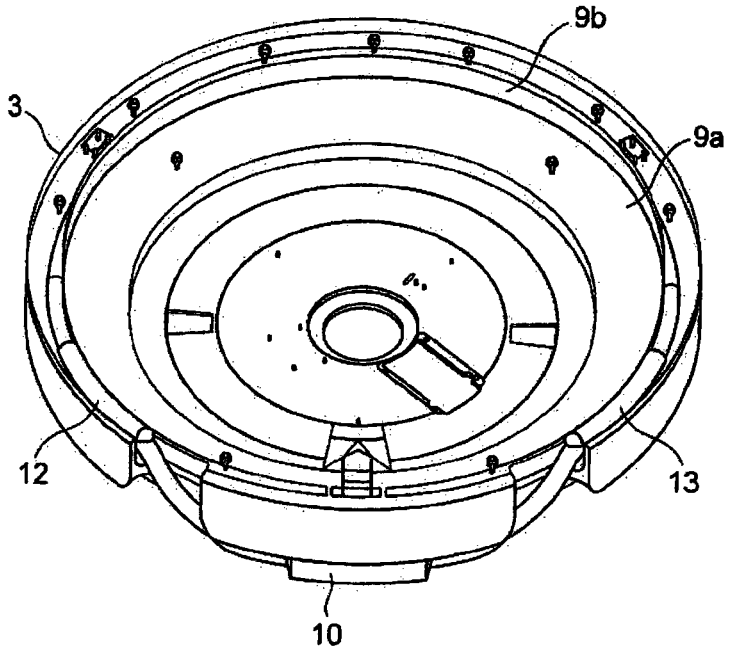
FIG. 8 shows a perspective view from above of the roulette wheel apparatus of FIG. 1 with the roulette wheel removed.

FIGS. 7 and 8 show respective plan and perspective views from above of the roulette wheel assembly 1 with the roulette wheel 2 removed so that components located below the roulette wheel 2 can be seen.

The wheel base 3 comprises a substantially horizontal plate 8 arranged underneath the roulette wheel 2. When a roulette ball 100 is located in a slot compartment 6 the roulette ball 100 contacts an upper surface of the plate 8 through the bottomless slot compartment 6 and is supported by the plate 8. The upper face of the horizontal plate 8 is substantially flat, at least in the areas of the horizontal plate 8 lying beneath the slot compartments 6 of the roulette wheel 2.

The plate 8 is spaced apart from the bottom of the roulette wheel 2 so that the roulette wheel 2 can rotate freely without contacting the plate 8. The separation distance spacing the roulette wheel 2 from the plate 8 is preferably small in order to minimise the risk of dirt or small items entering the space between the roulette wheel 2 and the plate 8. Such dirt or objects could affect the rotation of the roulette wheel 2.

In the illustrated embodiment the plate 8 extends across substantially the whole area of the roulette wheel 2. In alternative embodiments the plate 8 may extend across only a part of the region below the roulette wheel 2. In one embodiment the plate 8 may extend across only the annular region below the slot compartments 6 of the roulette wheel 2.

The roulette wheel 2 is surrounded by a wheel bowl 9 having an inwardly sloping annular surface 9*a* with a raised vertical outer rim 9*b*. The inwardly sloping annular surface 9*a* is arranged so that it tends to direct a roulette ball 100 radially inwardly towards the roulette wheel 2, and the raised outer rim 9*b* is arranged to prevent a roulette ball 100 escaping from the wheel bowl 9. The wheel bowl 9 is fixed relative to the wheel base 3, and the roulette wheel 2 is arranged to rotate within the fixed wheel bowl 9.

The wheel bowl 9 may include one or more ball deflectors projecting from the annular surface 9*a*. These ball deflectors may be shaped and arranged similarly to those used in conventional roulette wheels.

When used to play roulette, the roulette wheel assembly 1 will usually be mounted on a table so that the bottom of the roulette wheel assembly 1 is not visible or accessible to users. In embodiments where the roulette wheel assembly 1 is being used to play roulette by remote users only, this may not be required because the visibility of the remote users is restricted to the fields of view of any provided cameras, and of course remote users cannot access the roulette wheel assembly 1 in any event.

The roulette wheel 2 and wheel bowl 9 are arranged so that a roulette ball 100 travelling relatively quickly around the wheel bowl 9 will travel around the upper outer edge of the inwardly sloping wheel bowl 9, being retained within the wheel bowl 9 by the raised outer rim 9*b*. A roulette ball 100 travelling around the wheel bowl 9 in this way will gradually slow due to friction and air resistance, and will eventually move inwardly across the wheel bowl 9 and roulette wheel 2 until it lands in and is retained by one of the slot compartments 6. The period when a roulette ball 100 travels around the upper outer edge of the inwardly sloping wheel bowl 9 between the roulette ball 100 being launched into the wheel bowl 9 and the roulette ball 100 beginning its descent towards the roulette wheel 2 is commonly referred to as the spin cycle. The point when the roulette ball 100 begins its descent towards the roulette wheel 2 is commonly referred to as the drop.

In order to allow automatic operation of the roulette wheel assembly 1 to play roulette, the roulette wheel assembly 1 further comprises a ball launching mechanism 10, a ball recovery mechanism 20, and at least one ball position sensor 30. The ball launching mechanism 10, ball recovery mechanism 20, and ball position sensor 30 all operate under the control of the control system 7.

An overview of the operations of the roulette wheel assembly 1 under the control of the control system 5 in order to provide an automatic game of roulette is as follows.

Firstly, the motor 4 drives the roulette wheel 2 to rotate with a direction selected by the control system 5.

Then, the ball launching mechanism 10 launches a roulette ball 100 into the wheel bowl 9 in the opposite direction to the direction of rotation of the roulette wheel 2, with the roulette ball 100 having a speed and a spin selected by the control system 5.

The roulette ball 100 will then travel around the wheel bowl 9 during the spin cycle, gradually slowing due to friction and air resistance, until the drop occurs and the roulette ball 100 moves under the influence of gravity downwardly and inwardly across the inwardly sloping surfaces 9*a* and 7 of the wheel bowl 9 and the roulette wheel 2, and ultimately enters and is retained by one of the slot compartments 6.

The ball position sensor 30 determines the position of the roulette ball 100 in a slot compartment 6, and provides signals identifying this position to the control system 5. The control system 5 uses these position signals to determine when the roulette ball 100 has come to rest and to identify which one of the slot compartments 6 the roulette ball 100 has come to rest and been retained in. As is well known, in the game of roulette users or players place various bets which are based on which of the slot compartments 6 the roulette ball 100 is finally retained in.

Then, after the slot compartment 6 in which the roulette ball 100 is retained has been determined, the ball recovery mechanism 20 operates under the control of the control system 5 to remove the roulette ball 100 from the slot compartment 6 and return it to the ball launching mechanism 10 so that it can be launched again in a later game of roulette.

In some embodiments the roulette wheel assembly 1 may be incorporated into an automatic roulette system together with betting apparatus to automatically receive bets placed by users, means to identify winning bets among the placed bets, and payment apparatus allowing users to be paid any winnings. In some embodiments the betting apparatus and payment apparatus may allow users to place bets and be paid any winnings remotely, for example over a communications network such as the Internet. In such embodiments allowing remote betting and payment the automatic roulette system may also comprise one or more cameras to allow remote users to view the roulette wheel assembly 1.

In such embodiments the control system. 5 may further comprise means for communication with other parts of the automatic roulette system.

In such embodiments the control system 5 may provide signals to the betting apparatus indicating, or based upon, the timing of the launching of a roulette ball 100 into the wheel bowl 9. The betting apparatus may use these signals to determine when to stop taking new bets on a game of roulette from users. The stopping of taking new bets on a game of roulette is generally referred to as closing the game. Traditionally a roulette game is closed after the roulette ball 100 has been launched into the wheel bowl 9, during the spin cycle.

In such embodiments the control system 5 may provide signals to the betting apparatus indicating which one of the slot compartments 6 the roulette ball 100 is retained in. The betting apparatus may use these signals to determine which bets by users are winning bets.

In other embodiments, one, some, or all of the functions of receiving bets, identifying winning bets, and paying out winnings, may be carried out manually by a croupier.

Figure 9:
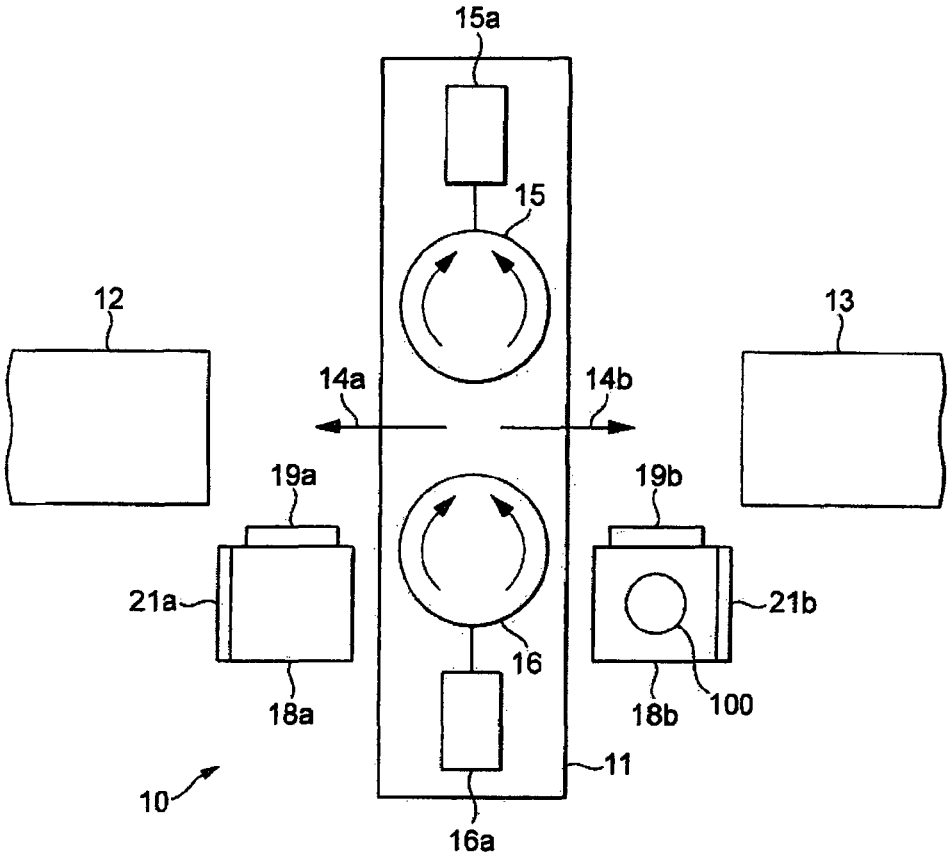
FIG. 9 shows a schematic view of a first embodiment of a ball launcher of the roulette wheel apparatus of FIG. 1.

FIG. 9 shows a schematic view of a first embodiment of the ball launching mechanism 10.

In the first embodiment the ball launching mechanism 10 comprises a ball firer 11, and a pair of ball transport tubes 12 and 13 arranged on opposite sides of the ball launcher 11. The ball firer 11 is arranged to launch the roulette ball 100 into a selected one of the ball transport tubes 12 and 13 with a predetermined speed and spin, as instructed by the control system 5.

The ball firer 11 is able to fire the roulette ball 100 in either of two opposite directions into a selected one of the ball transport tubes 12 and 13, as indicated by the arrows 14*a* and 14*b*. The ball firer 11 can be instructed by the control system 5 to fire the roulette ball 100 in the desired direction, and as a result the roulette ball 100 from the ball firer 11 will be directed along a selected one of the ball transport tubes 12 and 13.

The ball transport tubes 12 and 13 are circular in cross-section and have a substantially constant internal diameter slightly larger than the diameter of a roulette ball 100 so that a roulette ball 100 travelling along a ball transport tube 12 or 13 will travel smoothly without excessive friction. Each of the transport tubes 12 and 13 extends from the ball firer 11 to the wheel bowl 9 and enters the wheel bowl 9 through a respective opening 12*a* and 13*a* in the raised outer rim 9*b*. The part of each of the transport tubes 12 and 13 close to the respective openings 12*a* and 13*a* in the raised outer rim 9*b* are arranged to be substantially straight and aligned substantially tangential to an inner surface of the raised outer rim 9*b* so that a roulette ball 100 exiting from a transport tube 12 or 13 is launched smoothly onto the raised outer rim 9*b* of the wheel bowl 9. Preferably, there is little or no discontinuity or step where the roulette ball 100 passes out of the end the tube 12 or 13 and into the wheel bowl 9. Any such discontinuity could cause the roulette ball 100 to jump or skip undesirably on entering the wheel bowl 9.

In some embodiments the openings 12*a* and 13*a* in the raised outer rim 9*b* where the transport tubes 12 and 13 enter the wheel bowl 9 may be located in a surface of the outer rim 9*b* above the upper edge of the sloping surface 9*a* of the wheel bowl 9 where the sloping surface 9*a* of the wheel bowl 9 contacts the vertical raised outer rim 9*b*, so that a roulette ball 100 moving in a circle around the wheel bowl 9 at the upper edge of the inclined surface 9*a* and in contact with the raised outer rim 9*b* will not come into contact with the openings 12*a* and 13*a*.

The transport tubes 12 and 13 enter the wheel bowl 9*a* from mutually opposed rotational directions. Accordingly, the ball launching mechanism 10 can launch the roulette ball 100 into the wheel bowl 9*a* in either direction as desired by the ball firer 11 firing the roulette ball 100 into the correct one of the transport tubes 12 and 13. Accordingly, the control system 5 can control the direction in which the roulette ball 10 is launched into the wheel bowl 9. In the illustrated embodiment the transport tube 12 will launch a roulette ball 100 into the wheel bowl 9*a* in a clockwise direction while the transport tube 13 will launch a roulette ball 100 into the wheel bowl 9*a* in an anticlockwise direction.

As is shown in FIG. 9, the ball firer 11 comprises a pair of opposed spaced apart wheels 15 and 16 arranged to rotate about parallel axes of rotation. The wheels 15 and 16 are resiliently, or spring, mounted and are separated by a distance slightly smaller than the diameter of a roulette ball 100 so that the wheels 15 and 16 mutually define a gap or nip 17 between them. The wheels 15 and 16 are connected to respective wheel drive motors 15*a* and 16*a* arranged to rotate the wheels 15 and 16 in respective opposite directions at predetermined speeds as instructed by the control system 5 so that the rotation of the wheels 15 and 16 tends to pull a roulette ball 100 into and through the nip 17 and fire the roulette ball 100 out from between the wheels 15 and 16 in a selected one of the two opposite firing directions 14*a* and 14*b* and into one of the ball transport tubes 12 and 13. The drive motors 15*a* and 16*a* can rotate each of the wheels 15 and 16 in both directions, and the directions of rotation of the wheels 15 and 16 will determine which direction 14*a* and 14*b* the roulette ball 100 is fired in.

Although the nip 17 defined between the wheels 15 and 16 is smaller than the diameter of the roulette ball 100, because the wheels 15 and 16 are resiliently mounted they are able to move to allow the roulette ball 100 to pass between them.

As is explained above, the direction in which the roulette ball 100 is launched into the wheel bowl 9 is determined by which of the transport tubes 12 and 13 the roulette ball 100 is directed into, which in turn is determined by the directions of rotation of the wheels 15 and 16 selected by the control system 5. Accordingly, the direction with which the roulette ball 100 is launched into the wheel bowl 9 can be controlled by the control system 5 controlling the direction of rotation of the wheels 15 and 16, and the speed with which the roulette ball 100 is launched into the wheel bowl 9 and the direction and speed of any spin of the roulette ball 100 can be controlled by the control system 5 appropriately selecting the speeds of rotation of the rotating wheels 15 and 16.

The ball launching mechanism 10 further comprises a first ball magazine 18*a* and a second ball magazine 18*b*. The roulette ball 100 is retained in one of the first and second ball magazines 18 and 18*b* before the roulette ball 100 is launched. Each ball magazine 18*a*, 18*b* comprises a respective ball release valve 19*a*, 19*b* which selectively releases the roulette ball 100 from the respective magazine 18*a* or 18*b* to the ball firer 11 to be launched by the rotating wheels 15 and 16. The two ball magazines 18*a* and 18*b* are arranged to feed the roulette ball 100 to the rotating wheels 15 and 16 from respective opposite sides so that the roulette ball 100 can pass between the wheels 15 and 16 and be fired in respective opposite directions.

In the illustrated embodiment the first magazine 18*a* is arranged to feed the roulette ball 100 to the left hand side of the rotating wheels 15 and 16 so that the roulette ball 100 can pass between the wheels 15 and 16 and be fired in the right hand direction 14*b* into the ball transport tube 13. Accordingly, a roulette ball 100 fed from the first magazine 18*a* will be launched into the wheel bowl 9 in an anticlockwise direction. The magazine 18*b* is arranged to feed the roulette ball 100 to the right hand side of the rotating wheels 15 and 16 so that the roulette ball 100 can pass between the wheels 15 and 16 and be fired in the left hand direction 14*a* into the ball transport tube 12. Accordingly, a roulette ball 100 fed from the second magazine 18*b* will be launched into the wheel bowl 9 in a clockwise direction.

In some embodiments the ball magazines 18*a* and 18*b* may be arranged so that the roulette ball 100 will roll by gravity into the ball firer 11, but is selectively blocked from doing so by the respective ball release valve 19*a* and 19*b*. In such embodiments each ball release valve 19*a*, 19*b* may comprise an arm or similar element which can be selectively moved between positions where it blocks, or does not block, the movement of the roulette ball 100 into the ball firer 11.

Optionally, the ball launching mechanism 10 may comprise ball sensors 21*a* and 21*b* to confirm whether a roulette ball 100 is present within the respective ball magazines 18*a* and 18*b*. If such a ball sensor 21 is provided, the control system 5 may be limited to select as the launch direction for the roulette ball 100 in the next game the launch direction associated with the one of the ball magazines 18*a* and 18*b* in which the roulette ball 100 is detected. If such a ball sensor 21 is provided, the control system 5 may be inhibited from attempting to start a new game of roulette when no roulette ball 100 is detected as being present in the ball magazines 18*a* and 18*b*.

Such ball sensors 21*a* and 21*b* may be any known type of ball sensor, such as an electro-optical sensor, a pressure sensor, or a mechanical pressure switch.

In the illustrated embodiment a respective wheel drive motor 15*a* and 16*a* is directly connected to each of the wheels 15 and 16 and the motors 15*a* and 16*a* and wheels 15 and 16 are resiliently mounted. In an alternative embodiment a respective wheel drive motor 15*a* and 16*a* may be arranged to drive each of the wheels 15 and 16 through a flexible coupling, and only the wheels 15 and 16 may be resiliently mounted.

In some embodiments the wheels 15 and 16 and wheel drive motors 15*a* and 16*a* may be connected through a variable drive mechanism, such as a gearbox.

In alternative embodiments a single wheel drive motor may be arranged to drive both wheels 15 and 16 through a suitable variable drive mechanism.

In alternative embodiments one or both of the wheels 15 and 16 may be rigidly mounted and one or both of the wheels 15 and 16 may be formed of resilient material. In such embodiments the resilience of the, or each, wheel 15 and 16 will allow the roulette ball 100 to pass between them and through the nip 17.

In some alternative embodiments the wheels 15 and 16 may be both resiliently mounted and comprise a resilient material.

In the illustrated embodiment the wheels 15 and 16 comprise a material having a high friction coefficient in order for the rotating wheels 15 and 16 to efficiently accelerate and apply spin to the roulette ball 100. In some embodiments the wheels 15 and 16 may comprise rubber, latex, or foam silicon. In some embodiments the wheels 15 and 16 may have a composite structure with at least an outer rim of the wheels being formed of the high friction coefficient material.

The speed at which the roulette ball 100 will be fired out from between the two rotating wheels 15 and 16, and the speed at which roulette ball 100 will be launched into the wheel bowl 9 will depend upon the speeds of rotation of the wheels 15 and 16. For any specific instance of ball launch, the speed at which the roulette ball 100 will be launched into the wheel bowl 9 will usually be slower than the speed at which the roulette ball 100 was fired out from between the two rotating wheels 15 and 16, due to frictional losses. However, there will be a consistent relationship between these two speeds.

In the illustrated embodiment the length of the two transport tubes 12 and 13 is the same and their geometries are a mirror images of one another so that the relationship between the speeds of rotation of the wheels 15 and 16 and the speed at which the roulette ball 100 is launched into the wheel bowl 9 is constant regardless of the direction in which the roulette ball 100 is launched. In some examples this may not be the case.

The ball firer 11 is arranged to be able to selectively drive the two wheels 15 and 16 to rotate at different speeds using their respective motors 15*a* and 16*a*.

When the two wheels 15 and 16 are driven at the same speed a roulette ball 100 passing between them will be accelerated to the speed of the wheels 15 and 16 and launched out from the nip 17 between the two wheels 15 and 16 at this speed without any spin.

When the two wheels 15 and 16 are driven at different speeds, a roulette ball 100 passing between them will be accelerated to the average speed of the wheels 15 and 16 and launched out from the nip 17 between the two wheels 15 and 16 at this average speed. Further, the difference between the speeds of the two wheels 15 and 16 will impart a spin to the roulette ball 100 so that the roulette ball 100 will be launched out from the nip 17 between the two wheels 15 and 16 with both a speed and a spin. The direction of the spin applied to the roulette ball 100 can be controlled by appropriately selecting which one of the rotating wheels 15 and 16 is spinning faster, and the speed of the spin can be controlled by appropriately selecting the difference between the speeds of the rotating wheels 15 and 16.

Thus, the speed and spin of the launched roulette ball 100 will depend upon the speeds of the wheels 15 and 16. The relevant speed of each wheel 15, 16 is the speed of movement of the contact surface between the wheel 15, 16 and the roulette ball 100. In examples where the wheels 15 and/or 16 comprise resilient material the speed of movement of the contact surface between the wheel 15, 16 and the roulette ball 100 may not be the same as the speed of movement of the rim of the wheel 15, 16 because the resilient material may allow the contact surface to move radially inward from the rim.

In the illustrated embodiment the wheels 15 and 16 rotate in opposite directions so that the rotation of the wheels 15 and 16 tends to pull a roulette ball 100 into and through the nip 17. This is not essential. In other embodiments one of the wheels 15 and 16 may be stationary, or the wheels 15 and 16 may rotate in the same direction, depending upon the launch speed and speed and direction of spin which it is desired to impart to the roulette ball 100.

In the illustrated embodiment the wheels 15 and 16 are the same size. In other embodiments the wheels 15 and 16 may have different sizes.

In embodiments where both of the wheels 15 and 16 are driven by a single motor through a variable drive mechanism the drive mechanism may be arranged to be able to rotate the wheels 15 and 16 at different speeds, and at different relative speeds.

In operation, when the roulette wheel apparatus 1 is instructed to begin playing a game of roulette, the control system 5 selects a desired direction of spin of the roulette wheel 2 and a desired direction of launch of the roulette ball 100. The direction of launch of the roulette ball 100 is selected to be opposite to the direction of spin of the roulette wheel 2.

In the illustrated embodiment the direction of launch of the roulette ball 100 is determined by which of the magazines 18*a* and 18*b* contains the roulette ball 100. Accordingly, the control system 5 selects both the direction of launch of the roulette ball 100 and the direction of spin of the roulette wheel 2 based on which of the magazines 18*a* and 18*b* routes the roulette ball 100 to the rotating wheels 15 and 16. The control system 5 may maintain a record of which of the magazines 18*a* and 18*b* the roulette ball 100 has been returned to after each game for use in selection of the direction of spin and direction of launch in a subsequent game.

In embodiments where ball sensors 21*a* and 21*b* are provided, these may be used to detect or confirm which magazine 18*a* and 18*b* contains the roulette ball 100 for use in selection of the direction of spin and direction of launch in a subsequent game.

The control system 5 then sends appropriate control signals to the drive motor 4 to spin the roulette wheel 2 in the selected direction. The direction and speed of spin of the roulette wheel 2 is kept constant throughout the game until the slot compartment 6 in which the roulette ball 100 comes to rest at the end of the game has been determined.

Further, the control system 5 selects a desired speed of launch, and direction and amount of spin, of the roulette ball 100 and sends appropriate control signals to the ball firer 11 to rotate the wheels 15 and 16 at the necessary speeds to launch the roulette ball 100 with the desired direction and speed, and the desired direction and speed of spin. The control system 5 then instructs the appropriate ball release valve 19*a*, 19*b* to release the roulette ball 100 from the magazine 18*a* or 18*b* to the ball firer 11 for firing and launch.

The control system 5 may select the speed of launch to be a random value between predetermined upper and lower limits. These upper and lower limits may be set by the roulette wheel manufacturer and/or operator. Traditionally, when playing roulette the roulette ball is launched into the wheel bowl with sufficient speed to make a number of circuits of the wheel bowl in the spin cycle before the ball slows sufficiently to drop and move downward onto the rotating roulette wheel.

As in a conventional roulette wheel, in the roulette wheel apparatus 1 of the present invention the launched roulette ball 100 will initially travel around the outer edge of the wheel bowl 9. The roulette ball 100 will then slow, and when the speed of the roulette ball 100 is sufficiently low the roulette ball 100 will move inwardly towards the roulette wheel 2.

The lower and upper limits on the launch speed of the roulette ball may be selected based on the minimum and maximum length of time, or a number of circuits, respectively that it is desired for the roulette ball to spend travelling around the outer edge of the inwardly sloping surface 9*a* of the wheel bowl 9 in contact with the rim 9*b*, before it moves inward, or in other words, the desired length of the spin cycle. If the spin cycle is too short, it may become possible to predict to some extent which pocket the ball will end up in, before making a bet. Further, it is usual when playing roulette for users to place bets during the spin cycle, so if the spin cycle is too short it may disrupt the playing of the game. Further, if the spin cycle is too long the amount of time taken to play each game of roulette may become excessive, unacceptably reducing the number of games which can be played in a given time, or causing some users to become bored and lose interest in the game. The lower and upper limits of the launch speed may be set taking these points into account.

The control system 5 may select the direction of spin of the roulette ball 100 at random. Further, the control system 5 may select the speed of spin of the roulette ball 100 to be a random value below a predetermined upper limit. This upper limit may be set by the roulette wheel manufacturer and/or operator.

It is not essential that the roulette ball 100 is spinning on every occasion. Accordingly, it is not usually necessary to set a minimum spin value limit. The amount and direction of spin applied to the roulette ball 100 will generally change the deceleration and acceleration properties of the roulette ball 100 after launch. In practice, the upper limit on the spin speed may be determined by the spin speed at which users will perceive the effects of the spin on the movement of the roulette ball 100 as resulting in strange or unexpected movement properties. If users are able to perceive strange or unexpected movements of the roulette ball 100 as a result of the spin, they may interpret this as indicating that the game is faulty, or is in some way rigged, and become unwilling to play the game.

As is explained above, in the present invention each of the launch speed of the roulette ball 100, and the spin speed and direction of the roulette ball 100 may be randomly selected by the control system 5, and so varied unpredictably from game to game.

The random selection of these operating parameters, which will result in their changing unpredictably, may increase the difficulty to users of predicting which of the slot compartments 6 the roulette ball 100 will be retained in at the end of a game of roulette. In particular, the unpredictable changes in the launch speed and spin direction and speed of the roulette ball 100 may increase the difficulty to users of predicting which of the slot compartments 6*a* the roulette ball 100 will be retained in.

The roulette ball 100 is usually a featureless ball, without markings. The use of a featureless ball may make it difficult to identify the direction and speed of spin of the roulette ball 100 by observation. Accordingly, the unpredictable changes in the spin direction and speed of the roulette ball 100 may increase the difficulty to users of predicting which of the slot compartments 6 the roulette ball 100 will be retained in, and in particular may increase the difficulty to remote users of predicting which of the slot compartments 6 the roulette ball 100 will be retained in.

Accordingly, the random selection of these operating parameters may render users unable to meaningfully predict the outcome of a game of roulette, preserving the probability calculations underpinning the game that allow a game operator to make a profit.

In some embodiments the roulette wheel apparatus 1 may comprise a single roulette ball 100. In other embodiments the roulette wheel apparatus 1 may comprise a plurality of roulette balls 100, and use these one at a time to play games of roulette. In embodiments comprising a plurality of roulette balls 100, these roulette balls 100 may have different weights to increase unpredictability.

The spin direction of the roulette wheel 2 may be reversed in successive games by arranging for the roulette ball 100 to be returned to alternate ones of the magazines 18*a* and 18*b* in successive games. Alternatively, this can be done by arranging for the roulette ball 100 to be returned to an appropriate one of the magazines 18*a* and 18*b* based on the direction of spin of the roulette wheel 2 in the current game.

In some examples the spin direction of the roulette wheel may instead be varied in a different predetermined sequence, or randomly selected, by appropriately selecting which of the magazines 18*a* and 18*b* the roulette ball 100 is returned to, to further increase the difficulty of predicting the outcome of a game of roulette.

As is explained above, the spin direction of the roulette wheel 2 and the launch direction of the roulette ball 100 will usually be in opposite directions. In some examples the spin direction of the roulette wheel 2 and the launch direction 100 may be randomly selected to sometimes be in the same direction and sometimes be in opposite directions to further increase the difficulty of predicting the outcome of a game of roulette.

In some embodiments the spin speed of the roulette wheel 2 may also be randomly selected by the control system 5.

In the illustrated embodiment of the ball launcher 11 both of the wheels 15 and 16 are driven. In an alternative embodiment of the ball launcher only one of the wheels 15 and 16 is driven by a motor, while the other one of the wheels 15 and 16 is free to rotate, but is not driven.

In this alternative embodiment, when a roulette ball 100 is pulled into the nip 17 between the wheels 15 and 16 by the rotation of the driven wheel, the non-driven wheel will rotate as a result of frictional forces acting between the roulette ball 100 and the two wheels 15 and 16. The roulette ball 100 passing between the wheels 15 and 16 will be accelerated and launched out from the nip 17 between the two wheels 15 and 16 with both a speed and a spin. The direction of the spin applied to the roulette ball 100 will depend upon which one of the wheels 15 and 16 is the driven wheel, and the speed of the spin will depend upon the speed of the driven wheel and the amount of drag, that is frictional resistance to rotation, of the non-driven wheel.

In this alternative embodiment the speed of launch and spin speed of the roulette ball 100 may be related so that the values of these operating parameters cannot be independently selected by the control system 5. However, the control system 5 may still be able to select sufficient different random values of these related operating parameters that the difficulty of predicting the outcome of a game of roulette is maintained.

In a further alternative embodiment in which only one of the wheels 15 and 16 is driven, the drag of the non-driven wheel may be varied to different predetermined values under the control of the control system 5. In some such embodiments the drag of the non-driven wheel may be varied by applying a brake to the non-driven wheel with different predetermined amounts of force. This may allow the relationship between the speed of launch and spin speed of the roulette ball 100 to be varied, and so increase the difficulty of predicting the outcome of a game of roulette.

Figure 10:
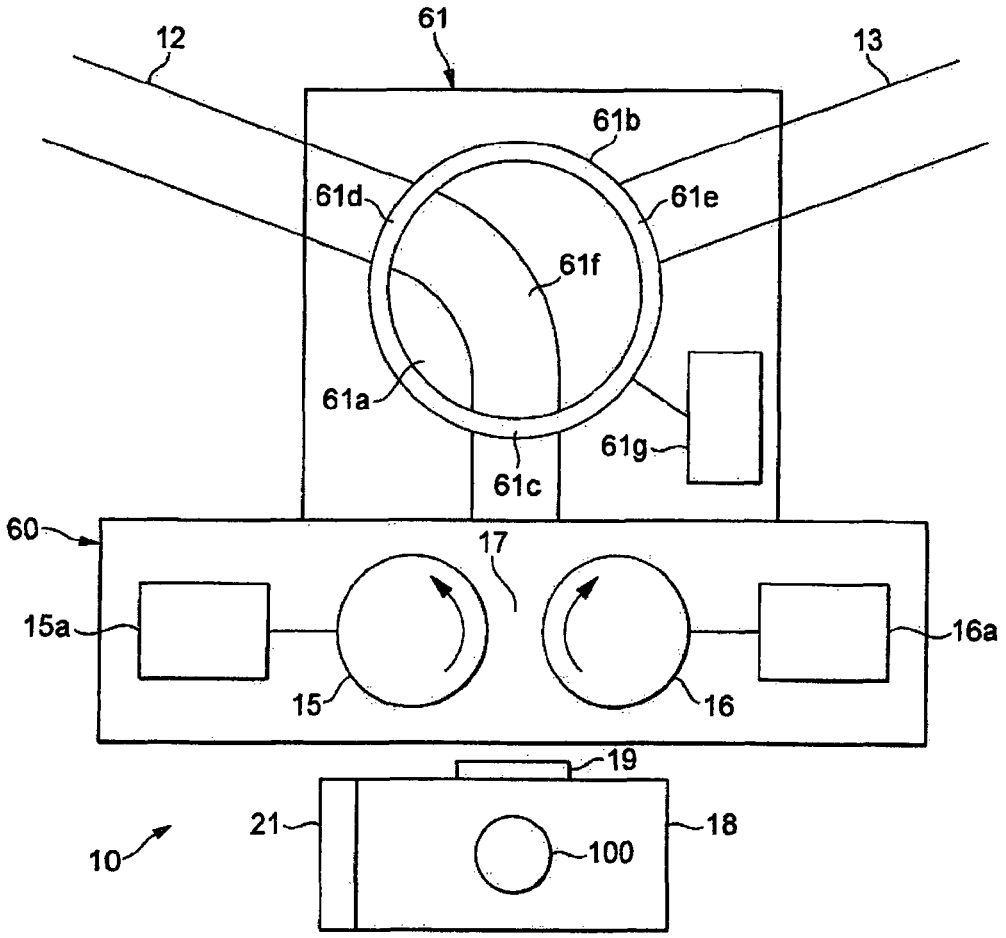
FIG. 10 shows a schematic view of a second embodiment of a ball launcher of the roulette wheel apparatus of FIG. 1.

A second embodiment of the ball launching mechanism 10 is shown in FIG. 10. In the second embodiment the ball launching mechanism 10 comprises a ball firer 60, a ball switcher 61, and a pair of ball transport tubes 12 and 13. The ball firer 60 is arranged to fire the roulette ball 100 into the ball switcher 61 with a predetermined speed and spin instructed by the control system 5. The ball switcher 61 is arranged to direct the moving roulette ball 100 into a selected one of the ball transport tubes 12 and 13, as instructed by the control system 5.

The ball switcher 61 comprises a switching member 61*a* rotatably mounted in a switch casing 61*b*. The switch casing 61*b* includes an inlet opening 61*c* and two outlet openings 61*d* and 61*e*. A curved connecting passage 61*f* passes through the switching member 61*a* and is shaped so that the curved connecting passage 61*f* can be arranged to connect the inlet opening 61*c* with either one of the outlet openings 61*d* and 61*e* by rotating the switching member 61*a* to a corresponding orientation within the casing 61*b*.

The ball firer 60 is arranged to fire the roulette ball 100 into the ball switcher 61 through the inlet opening 61*c*. The outlet openings 61*d* and 61*e* are connected to the ball transport tubes 12 and 13 respectively. The switching member 61*a* can be rotated by a switching motor 61*g* under the control of the control system 5 so that the curved connecting passage 61*f* will connect the inlet opening 61*c* with a selected one of the outlet openings 61*d* and 61*e*, and as a result, a roulette ball 100 fired from the ball firer 11 will be directed into a selected one of the ball transport tubes 12 and 13.

In the illustrated embodiment the roulette ball 100 travels directly from the ball firer 60 to the ball switcher 61. In some alternative embodiments the roulette ball 100 may travel between the ball firer 60 and the ball switcher 61 along a connecting ball guide.

In other embodiments different types of ball switcher may be used.

The ball firer 60 comprises a pair of opposed spaced apart wheels 15 and 16 driven to rotate in respective opposite directions at predetermined speeds by respective wheel drive motors 15*a* and 16*a* under the control of the control system 5 similarly to the ball firer 11 of the previous embodiment.

When the wheels 15 and 16 are driven to rotate by their respective motors 15*a* and 16*a* and a roulette ball 100 is fed into the nip 17 defined between the two rotating wheels 15 and 16, the roulette ball 100 is pulled through the nip 17 and is fired out from between the two wheels 15 and 16 into the inlet opening 14*c* of the ball switcher 14.

The ball firer 60 always fires the roulette ball 100 in the same direction, towards the ball switcher 61. Accordingly, the ball firer 60 differs from the ball firer 11 of the previous embodiment in that each of the rotatable wheels 15 and 16 of the ball firer 60 is always rotated in the same respective direction, although the two rotatable wheels 15 and 16 rotate in respective opposite directions. Otherwise, the comments above regarding the ball firer 11 of the first embodiment and its component parts are equally applicable to the ball firer 60.

The ball transport tubes 12 and 13 are the same as in the first embodiment.

As is explained above, the direction in which the roulette ball 100 is launched into the wheel bowl 9 is determined by which of the transport tubes 12 and 13 the roulette ball 100 is directed into by the ball switcher 61 under the control of the control system 5. Accordingly the direction with which the roulette ball 100 is launched into the wheel bowl 9 can be controlled by the control system 5 controlling the position of the ball switcher 61, and the speed with which the roulette ball 100 is launched into the wheel bowl 9 and the direction and speed of any spin of the roulette ball 100 can be controlled by the control system 5 appropriately selecting the speed of rotation of the rotating wheels 15 and 16.

The ball launching mechanism 10 further comprises a ball magazine 63 in which the roulette ball 100 is retained before the roulette ball 100 is launched. The ball magazine 63 comprises a ball release valve 64 which selectively releases the roulette ball 100 from the magazine 63 to the ball firer 60 to be launched by the rotating wheels 15 and 16.

Optionally, the ball launching mechanism 10 may comprise a ball sensor 65.

The ball magazine 63, ball release valve 64 and ball sensor 65 have the same functions as the ball magazines 18*a* and 18*b*, ball release valves 19*a* and 19*b*, and the ball sensors 21*a* and 21*b* discussed above regarding the previous embodiment.

In operation, similarly to the first embodiment, when the roulette wheel apparatus 1 is instructed to begin playing a game of roulette, the control system 5 selects a desired direction of spin of the roulette wheel 2 and sends appropriate control signals to the drive motor 4 to spin the roulette wheel 2 in the selected direction. Further, the control system 5 selects a desired direction and speed of launch, and direction and amount of spin, of the roulette ball 100.

The control system 5 sends appropriate control signals to the ball switcher 14 to rotate the switching member 14*a* to the appropriate position to launch the roulette ball 100 in the desired direction, and to the ball launcher 11 to rotate the wheels 15 and 16 at the necessary speeds to launch the roulette ball 100 with the desired speed and the desired direction and speed of spin. The control system 5 then instructs the ball release valve 19 to release the roulette ball 100 from the magazine 18 to the ball launcher 11 for launch.

In the second embodiment the direction of launch of the roulette ball may be controlled using the ball switcher 61. Accordingly, the direction of launch of the roulette ball and the direction of spin of the roulette wheel 2 may be freely selected for each game.

The control system 5 may select the direction of spin randomly, or following a predetermined sequence. In one example the control unit 7 may select the direction of spin of the roulette wheel 2 to always be in the opposite direction to the direction of spin used in the most recent previous game of roulette.

In the illustrated embodiments the roulette wheel 2 can be rotated in either direction and the roulette ball 100 can be launched into the wheel bowl 9 in either direction. This is not essential, and some embodiments may only support roulette wheel rotation and/or ball launch in one direction. In embodiments where ball launch can only take place in one direction only one ball transport tube will be required. Further, one of the two magazines of the first embodiment can be omitted. Further, the ball switcher of the second embodiment can be omitted.

As is explained above, in the game of roulette it is traditional to launch the ball in the opposite direction to the direction of rotation of the roulette wheel. Accordingly, in embodiments which support one of roulette wheel rotation and ball launch in only one direction it may be preferred to also support the other one of roulette wheel rotation and ball launch in only one direction.

In the illustrated embodiment the magazine 18 of the ball launching mechanism 10 contains a single roulette ball 100. In other embodiments the magazine 18 may contain a plurality of roulette balls 100.

In the illustrated embodiments the ball launching mechanism has one or more magazines and ball release valves, which release a roulette ball 100 from a magazine to the rotating wheels 15 and 16. In some embodiments the magazines and ball release valves may be absent and the returned roulette ball 100 may be passed directly to the wheels 15 and 16. In such embodiments the roulette ball 100 will be drawn into the nip 17 between the wheels 15 and 16, and then launched, immediately rotation of the wheels 15 and 16 is started.

The above description refers to various parameters of the roulette game being randomly selected. In particular, the direction and speed of rotation of the roulette wheel, the direction and speed of launch of the roulette ball, and the direction and speed of rotation of the roulette ball may be randomly selected. By randomly selected it is meant that the parameter values selected cannot be predicted by a user, that is, a person playing the game of roulette. This selection of parameter values may be random or pseudo-random, or may be a predetermined sequence not disclosed to the users. It is not essential that all parameter values are selected in the same manner, values of different parameters may be selected in different manners.

Some parameters may have linked values so that only certain predetermined combinations of values may be selected for these linked parameters. For example, the direction of rotation of the roulette wheel and the direction of launch of the roulette ball may be linked to always be opposite directions.

For parameters having a range of possible values, such as speed of launch and speeds of rotation, parameter values may be selected from a continuous range of values across the possible values, or may be selected from a number of discrete predetermined values distributed across the range of possible values. It is not essential that all parameter values are selected in the same manner, values of different parameters may be selected in different manners.

FIGS. 11 to 14 show a third embodiment of the ball recovery mechanism 20. The ball recovery mechanism 20 according to the third embodiment may be used together with the ball launcher 10 according to the first embodiment.

Figure 11:
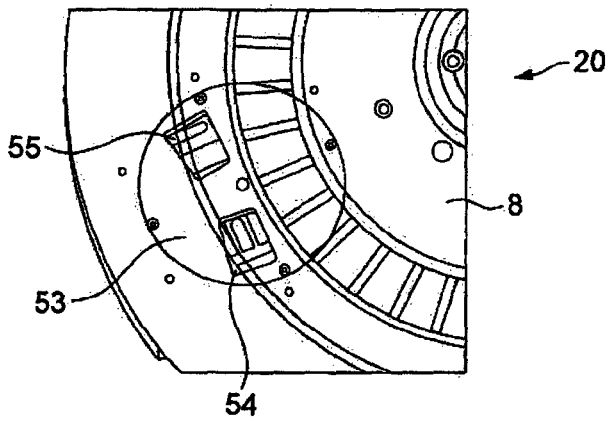
FIG. 11 shows a view of a third embodiment of a ball recovery mechanism in a closed position.
Figure 12:
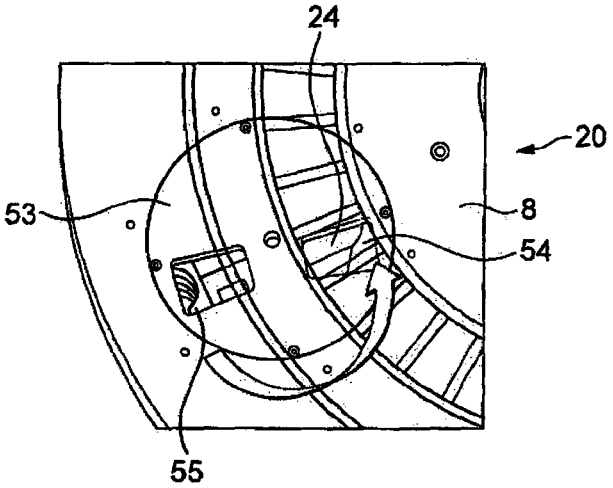
FIG. 12 shows a view of the third embodiment of a ball recovery mechanism in a first open position.
Figure 13:
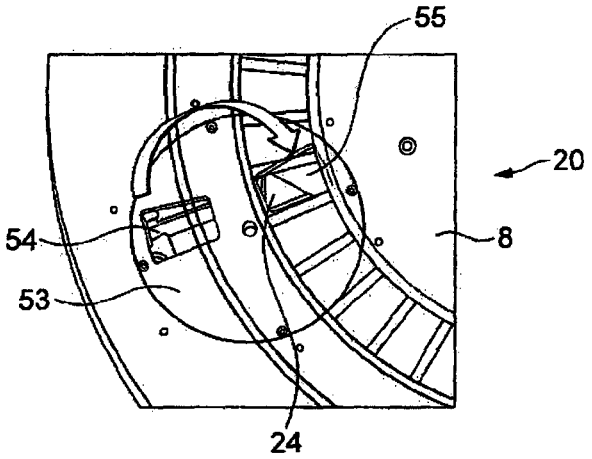
FIG. 13 shows a view of the third embodiment of a ball recovery mechanism in a second open position.
Figure 14:
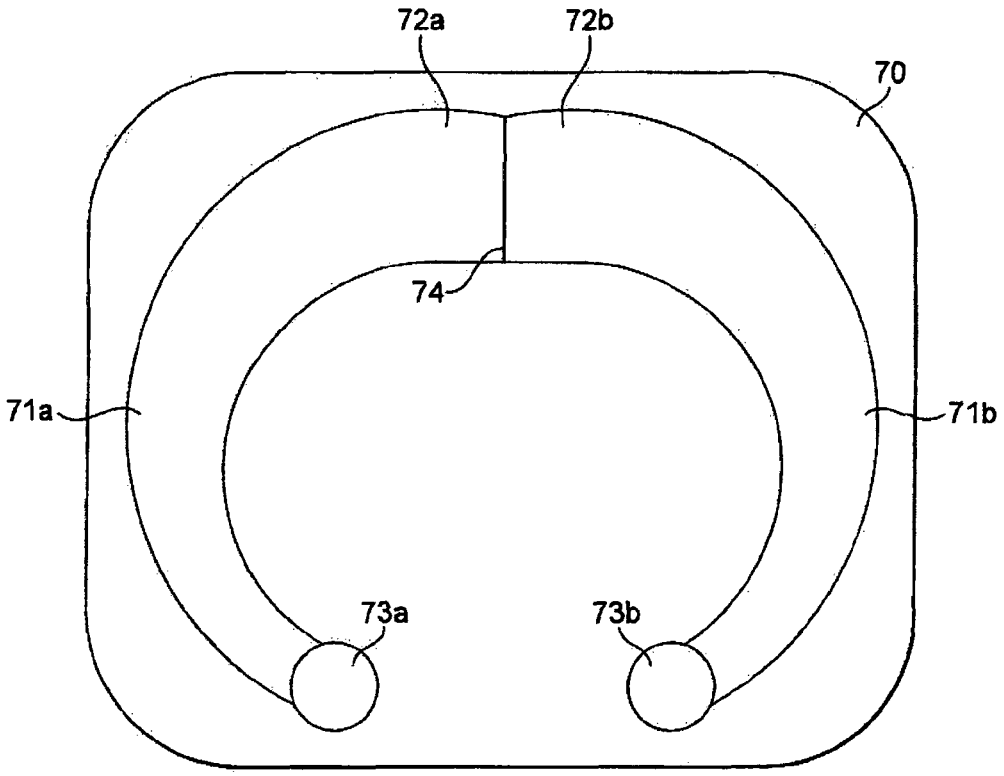
FIG. 14 shows a view of a ball return means according to the third embodiment.

FIGS. 11 to 13 show plan views from above of the roulette wheel apparatus 1 from above with the roulette wheel 2 removed, showing different phases of the operation of the ball recovery mechanism 20. In FIGS. 11 to 13 the positions of the slot compartments 6 and the edge of the roulette wheel 2 are shown, so that the location of the ball recovery mechanism can be clearly understood. FIG. 14 shows a plan view from above of a ball guide means for returning the roulette ball 100 to a magazine 18*a*, 18*b* for subsequent use.

In the third embodiment of FIGS. 11 to 14 the ball recovery mechanism 20 comprises a rotatable plate 53 located in a circular aperture in the base plate 8. The rotating movement of the plate 53 is driven by a motor (not shown) operating under the control of the control system 5 to selectively move the rotatable plate 53 between a closed position, shown in FIG. 11, and first and second open positions, shown in FIGS. 12 and 13 respectively. The rotatable plate has first and second apertures 54 and 55 passing through it, the first and second apertures 54 and 55 are the same size.

When the plate 53 is in the closed position shown in FIG. 11 the first and second apertures 54 and 55 are not located underneath the slot compartments 6 of the roulette wheel 2. The upper surface of the rotatable plate 53 is arranged to be flush with the upper surface of the horizontal plate 8 so that the horizontal plate 8 and rotatable plate 53 form a substantially smooth surface extending beneath the slot compartments 6 of the roulette wheel 2 when the plate 53 is in the closed position. Accordingly, when the roulette ball 100 is retained in one of the slot compartments 6 and the rotatable plate 53 is in the closed position the roulette ball 100 will be retained in the slot compartment 6 by resting on the horizontal plate 8 and the rotatable plate 53 as the roulette wheel 6 rotates.

When the rotatable plate 53 is in the first open position shown in FIG. 12, the first aperture 54 is located underneath the slot compartments 6 of the roulette wheel 2, and the second aperture 55 is not located underneath the slot compartments 6. The first aperture 54 is larger than a slot compartment 6 and is arranged so that when the rotatable plate 53 is in the first open position, as the roulette wheel 2 rotates each slot compartment 6 in turn passes over the first aperture 54, and moves through a position where the slot compartment 6 lies entirely over the first aperture 54. Accordingly, when the slot compartment 6 in which the roulette ball 100 is retained passes over the rotatable plate 53 in the first open position the roulette ball 100 is unsupported and drops through the first aperture 54. In the first open position the second aperture 55 does not interact with the roulette ball 100 because it is not underneath the slot compartments 6.

When the rotatable plate 53 is in the second open position shown in FIG. 13, the second aperture 55 is located underneath the slot compartments 6 of the roulette wheel 2, and the first aperture 55 is not located underneath the slot compartments 6. The second aperture 55 is the same size as the first aperture 54, that is, larger than a slot compartment 6, and is arranged so that when the rotatable plate 53 is in the second open position, as the roulette wheel 2 rotates each slot compartment 6 in turn passes over the second aperture 55, and moves through a position where the slot compartment 6 lies entirely over the second aperture 55. Accordingly, when the slot compartment 6 in which the roulette ball 100 is retained passes over the rotatable plate 53 in the second open position the roulette ball 100 is unsupported and drops through the second aperture 55. In the second open position the first aperture 54 does not interact with the roulette ball 100 because it is not underneath the slot compartments 6.

The location of the first aperture 54 when the rotatable plate 53 is in the first open position is not the same as the location of the second aperture 55 when the rotatable plate 53 is in the second open position. In the illustrated embodiment the location of the first aperture 54 when the rotatable plate 53 is in the first open position is located clockwise of the location of the second aperture 55 when the rotatable plate 53 is in the second open position, in terms of the rotation of the roulette wheel 2.

A ball guide 70 is located at least partially beneath the rotatable plate 53 and above the ball launcher 10. The ball guide 70 is shown in FIG. 14.

The ball guide 70 comprises a first ball channel 71*a* extending between a first ball landing area 72*a* and a first ball drop tube 73*a*. The first ball channel 71*a* is inclined so that a roulette ball 100 located in the first ball landing area 72*a* or the first ball channel 71*a* tends to move by gravity along the first ball channel 71*a* and drop down the first ball drop tube 73*a*. The first ball drop tube 73*a* connects to the ball launcher 10 so that a roulette ball 100 falling down the first ball drop tube 73*a* enters the first magazine 18*a* of the ball launcher 10.

The ball guide 70 further comprises a second ball channel 71*b* extending between a second ball landing area 72*b* and a second ball drop tube 73*b*. The second ball channel 71*b* is inclined so that a roulette ball 100 located in the second ball landing area 72*b* or the second ball channel 71*b* tends to move by gravity along the second ball channel 71*b* and drop down the second ball drop tube 73*b*. The second ball drop tube 73*b* connects to the ball launcher 10 so that a roulette ball 100 falling down the second ball drop tube 73*b* enters the second magazine 18*b* of the ball launcher 10.

The first and second ball landing areas 72*a* and 72*b* are separated by a raised ridge 74 (not on illustration), which prevents a roulette ball moving between the first and second ball landing areas 72*a* and 72*b*.

In the illustrated embodiment the first and second ball channels 71*a* and 71*b* are symmetrical. In other embodiments this may not be the case.

The ball guide means 70 is located so that the first ball landing area 72*a* is located beneath the position of the first aperture 54 when the rotatable plate 53 is in the first open position, and the second ball landing area 72*b* is located beneath the position of the second aperture 55 when the rotatable plate 53 is in the second open position. It should be noted that as a result the first ball landing area 72*a* is located clockwise of the second ball landing area 72*b*.

Accordingly, when the rotatable plate 53 is in the first open position the roulette ball 100 drops through the first aperture 54 onto the first ball landing area 72*a*. The roulette ball 100 then moves along the first ball channel 71*a* and is returned by the first ball drop tube 73*a* to the first ball magazine 18*a* of the ball launching mechanism 10 ready to be launched in a anticlockwise direction in a subsequent game of roulette.

Similarly, when the rotatable plate 53 is in the second open position the roulette ball 100 drops through the second aperture 54 onto the second ball landing area 72*b*. The roulette ball 100 then moves along the second ball channel 71*b* and is returned by the second ball drop tube 73*b* to the second ball magazine 18*b* of the ball launching mechanism 10 ready to be launched in an clockwise direction in a subsequent game of roulette.

In the illustrated embodiment the first and second apertures 54 and 55 are larger than a slot compartment 6. In other embodiments the first and second apertures 54 and 55 may be the same size as a slot compartment 6. Having the first and second apertures 54 and 55 larger than a slot compartment 6 may ensure that a roulette ball 100 in a slot compartment 6 of the rotating roulette wheel 2 is unsupported by the plate 8 and rotatable plate 53 for a sufficient period to ensure the roulette ball 100 passes through the first or second aperture 54 or 55, even when the roulette wheel 2 is rotating at high speed.

As is explained above, in operation of the roulette wheel apparatus 1 under the control of the control system 5 in order to provide an automatic game of roulette, the roulette wheel 2 is rotated and the ball launching mechanism 10 launches a roulette ball 100 into the wheel bowl 9. When the roulette ball 100 is retained by one of the slot compartments 6, the at least one ball position sensor 30 determines the position of the roulette ball 100 in the slot compartment 6, and provides signals identifying this position to the control system 5. The control system 5 then uses these position signals to determine when the roulette ball 100 has come to rest and to identify which one of the slot compartments 6 the roulette ball 100 has been retained in.

When a new game of roulette is started the rotatable plate 53 of the ball recovery mechanism 20 is in the closed position. Accordingly, the ball recovery mechanism 20 does not interfere with the roulette ball 100 as it moves around the roulette wheel 2 and comes to rest in one of the slot compartments 6.

When the roulette ball 100 has come to rest and the slot compartment 6 in which the roulette ball 100 is retained has been determined by the ball position sensor 30 and the control system 5, the control system 5 instructs the ball recovery mechanism 20 to recover the roulette ball 100 by moving the rotatable plate 53 into the one of the first and second open positions so that the roulette ball 100 can drop into the ball guide 70 through a respective one of the apertures 54 and 55 and be returned to the ball launching mechanism 10. As is explained above, one of the first and second open positions may be selected based on which direction the roulette ball 100 is to be launched in for the next game. After the roulette ball 100 has dropped through the respective one of the apertures 54 and 55, the rotatable plate 53 is moved back into the closed position.

In some embodiments where ball sensors 21*a* and 21*b* are provided in the ball magazines 18*a* and 18*b* the control system 5 may instruct the ball recovery mechanism 20 to move the rotatable plate 53 to the closed position in response to a ball sensor 21*a* or 21*b* confirming that the roulette ball 100 has been returned to a ball magazine 18*a* or 18*b*.

In some embodiments, when the ball position sensor 30 has identified which of the slot compartments 6 the roulette ball 100 is retained in, the control system 5 may instruct the ball recovery mechanism 20 to move the rotatable plate 53 into one of the first and second open positions before the identified slot compartment 6 passes over the rotatable plate 53, and to move the rotatable plate 53 back into the closed position after the identified slot compartment 6 passes over the rotatable plate 53. In such embodiments the ball position sensor 30 may be able to confirm that the roulette ball 100 is no longer present in the slot compartment 6 in addition to, or as an alternative to, a ball sensor 21*a* or 21*b* confirming that the roulette ball 100 has been returned to a ball magazine 18*a* or 18*b*.

In the illustrated embodiment of the ball recovery mechanism 20 the control system 5 may instruct the rotatable plate 53 to be rotated into respective ones of the first and second open positions to recover the roulette ball 100 depending on the intended direction of rotation of the roulette wheel 2 in the subsequent game of roulette. In the illustrated embodiment the rotatable plate 53 should be rotated into the first open position if it is intended to launch the roulette ball 100 in a clockwise direction in the subsequent game of roulette, and should be rotated into the second open position if it is intended to launch the roulette ball 100 in an anticlockwise direction in the subsequent game of roulette.

In examples of operation where the roulette wheel 2 is to be rotated in opposite directions in successive games of roulette and the roulette ball 100 is to be launched in the opposite direction to the rotation of the roulette wheel 2 the movement of the rotatable plate 53 may be based on the direction of rotation of the roulette wheel 2 in the current game of roulette. The rotatable plate 53 should be rotated into the first open position if the roulette wheel 2 is rotating clockwise in the current game of roulette, and should be rotated into the second open position if the roulette wheel 2 is rotating anticlockwise in the current game of roulette.

The illustrated embodiment of the ball recovery mechanism 20 comprises a rotating plate 53 with two apertures 54 and 55. In other embodiments different numbers of apertures may be provided. In some embodiments there may be only a single aperture.

In the illustrated embodiments the roulette ball 100 is recovered by being dropped into the ball guide means 70 to return the roulette ball 100 to the ball launching mechanism 10 along an inclined path. In other embodiments the roulette ball 100 may drop directly into the ball launching mechanism 10. In other embodiments the transport mechanism may comprise a powered conveyor.

Figure 15:
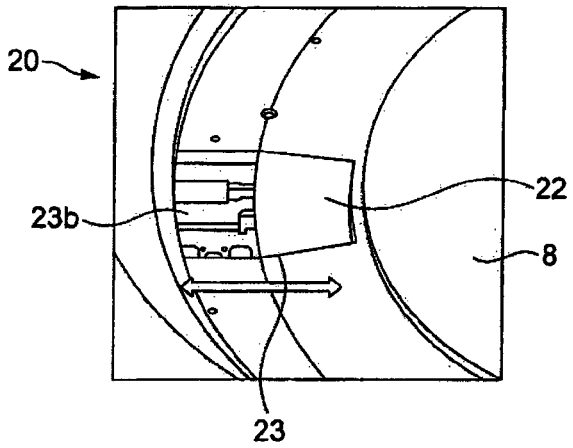
FIG. 15 shows a view of a fourth embodiment of a ball recovery mechanism in a closed position.
Figure 16:
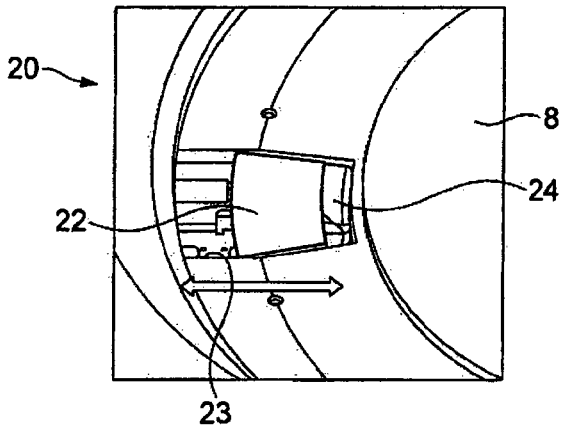
FIG. 16 shows a view of the fourth embodiment of a ball recovery mechanism in an intermediate position.
Figure 17:
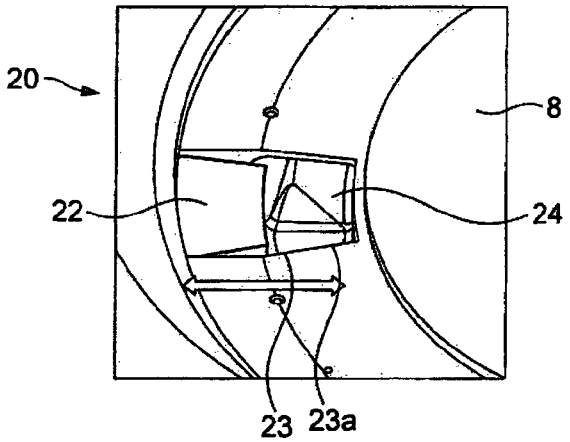
FIG. 17 shows a view of the fourth embodiment of a ball recovery mechanism in an open position.

FIGS. 15 to 17 show a fourth embodiment of the ball recovery mechanism 20. FIGS. 15 to 17 show views of the roulette wheel apparatus 1 from above with the roulette wheel 2 removed, and showing respective different phases of the operation of the fourth embodiment of the ball recovery mechanism 20. The ball recovery mechanism 20 according to the fourth embodiment may be used together with the ball launcher 10 according to the second embodiment.

In the fourth embodiment of FIGS. 15 to 17 the ball recovery mechanism 20 comprises a trapdoor 22 able to move between a closed position, shown in FIG. 15, and an open position, shown in FIG. 17.

The trapdoor 22 is arranged for sliding movement within an aperture 23 passing through the plate 8. The sliding movement of the trapdoor 22 is driven by a motor (not shown) operating under the control of the control system 5 to selectively move the trapdoor 22 between the closed and open positions. The trapdoor 22 is able to move between the closed position shown in FIG. 15 and the open position shown in FIG. 17. As the trapdoor 22 moves between the open and closed positions it moves through an intermediate position shown in FIG. 16.

When the trapdoor 22 is in the closed position the trapdoor 22 is located underneath the slot compartments 6 of the roulette wheel 2. The upper surface of the trapdoor 22 is arranged to be flush with the upper surface of the horizontal plate 8 so that the plate 8 and trapdoor 22 form a substantially smooth surface extending beneath the slot compartments 5 of the roulette wheel 2. Accordingly, when the roulette ball 100 is retained in one of the slot compartments 6 and the trapdoor 22 is in the closed position the roulette ball 100 will be retained in the slot compartment 6 by resting on the horizontal plate 8 and the trapdoor 22 as the roulette wheel 6 rotates.

When the trapdoor 22 is in the open position the trapdoor 22 is no longer located underneath the slot compartments 6 of the roulette wheel 2, so that a first open area 23*a* of the aperture 23 is located underneath the slot compartments 6 of the roulette wheel 2. The first open area 23*a* is larger than a slot compartment 6 and is located so that as the roulette wheel 2 rotates each slot compartment 6 in turn passes over the first open area 23*a* and moves through a position where the slot compartment 6 lies entirely over the first open area 23*a*. Accordingly, when the slot compartment 6 in which the roulette ball 100 is retained passes over the aperture 23 and the trapdoor 22 in the open position the roulette ball 100 is unsupported and drops through the first open area 23*a* of the aperture 23.

An opening 24 into the ball launching mechanism 10 is located beneath the first open area 23*a* of the aperture 23 so that a roulette ball 100 dropping into the opening 24 is returned to the ball magazine 63 of the ball launching mechanism 10 ready to be launched in a subsequent game of roulette.

In order to allow the trapdoor 22 to move between the closed and open positions the aperture 23 is larger than the trapdoor 22. As a result, when the trapdoor 22 is in the closed position as shown in FIG. 15 a second open area 23*b* of the aperture 23 is left unfilled by the trapdoor 22. The aperture 23 is arranged to extend radially outwardly relative to the roulette wheel 2 from the annular region of the plate 8 underneath the slot compartments 6 so that the trapdoor 22 can move between the radially inward closed position of FIG. 15 and the radially outward open position of FIG. 17. The trapdoor 21 and aperture 22 are shaped and dimensioned so that the second open area 23*b* is located beneath the sloped annular surface 7 of the roulette wheel 2, and is not located beneath the slot compartments 6. Accordingly, the second open area 23*b* is not visible in operation of the roulette wheel 2, and cannot interact with a roulette ball 100 retained in one of the slot compartments 6 of the roulette wheel 2 because such a roulette ball 100 will not pass over the second open area 23*b*.

In operation of the roulette wheel apparatus 1 the fourth embodiment of the ball recovery mechanism 20 is used in a similar manner to the third embodiment, and the comments above regarding the third embodiment are generally applicable to the fourth embodiment.

When a new game of roulette is started the trapdoor 21 of the ball recovery mechanism 20 is in the closed position. Accordingly, the ball recovery mechanism 20 does not interfere with the roulette ball 100 as it moves around the roulette wheel 2 and comes to rest in one of the slot compartments 6.

When the roulette ball 100 has come to rest and the slot compartment 6 in which the roulette ball 100 is retained has been determined by the ball position sensor 30 and the control system 5, the control system 5 instructs the ball recovery mechanism 20 to recover the roulette ball 100. The ball recovery mechanism 20 responds by moving the trapdoor 22 into the open position so that the roulette ball 100 can drop into the ball launching mechanism 10 through the first open area 23*a* of the aperture 23 and the opening 24. After the roulette ball 100 has dropped through the first open area 23*a* the trapdoor 22 is moved back into the closed position.

In some embodiments where a ball sensor 65 is provided in a ball magazine 63 the control system 5 may instruct the ball recovery mechanism 20 to move the trapdoor 22 to the closed position in response to the ball sensor 65 confirming that the roulette ball 100 has been returned to the ball magazine 63.

In some embodiments, when the ball position sensor 30 has identified which of the slot compartments 6 the roulette ball 100 is retained in, the control system 5 may instruct the ball recovery mechanism 20 to move the trapdoor 22 into the open position before the identified slot compartment 6 passes over the first open area 23*a*, and to move the trapdoor 22 back into the closed position after the identified slot compartment 6 passes over the first open area 23*a*. In such embodiments the ball position sensor 30 may be able to confirm that the roulette ball 100 is no longer present in the slot compartment 6 in addition to, or as an alternative to, the ball sensor 65 confirming that the roulette ball 100 has been returned to the ball magazine 63.

Figure 18:
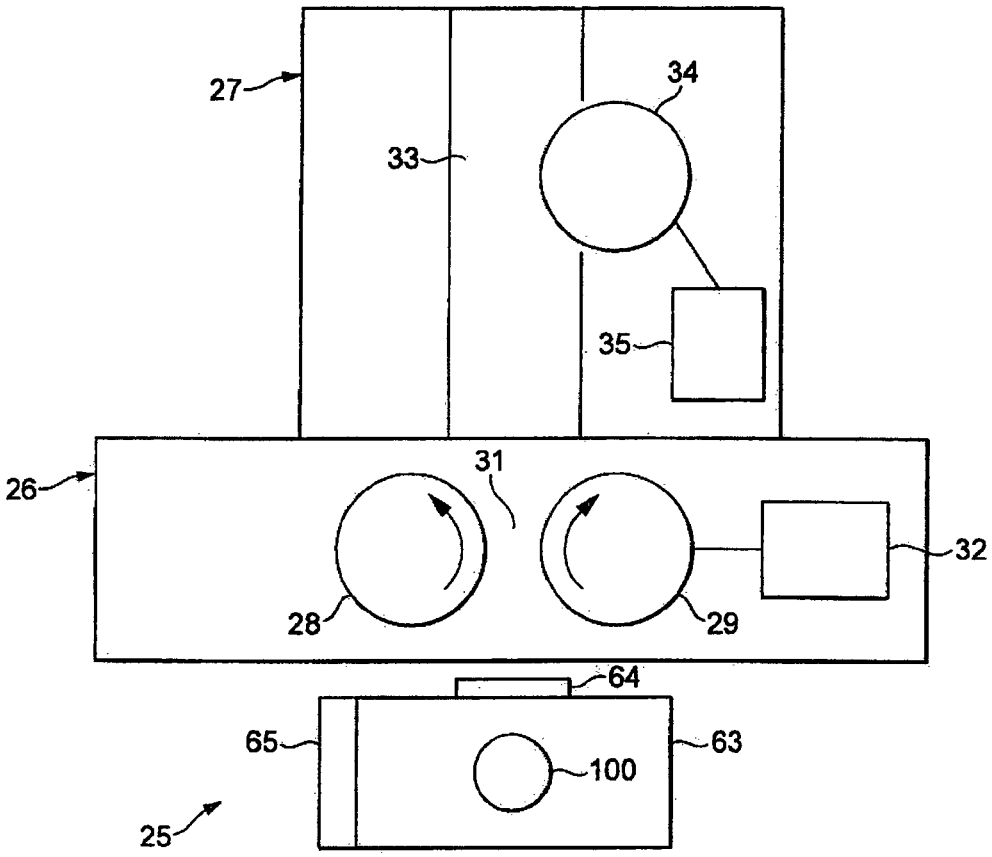
FIG. 18 shows a schematic view of a fifth embodiment of a ball launcher of the roulette wheel apparatus of FIG. 1.

FIG. 18 shows a fifth alternative embodiment of the ball launching mechanism 10.

In the example of the fifth embodiment shown in FIG. 18 the ball launching mechanism 10 comprises a ball firer 25 in place of the ball firer 60 of the second embodiment. The ball firer according to the fifth embodiment may be used in place of the ball firers of the other embodiments. In the fifth embodiment, the ball firer 25 comprises a ball accelerator unit 26 and a separate ball spinning unit 27 instead of the wheels 15 and 16 of the previously described embodiments, which act to simultaneously accelerate and apply spin to the roulette ball 100.

As is shown in FIG. 18, the ball accelerator unit 26 comprises a pair of opposed spaced apart wheels 28 and 29 arranged to rotate about parallel axes of rotation. The wheels 28 and 29 are resiliently, or spring, mounted and are separated by a distance slightly smaller than the diameter of a roulette ball 100 so that the wheels 28 and 29 mutually define a gap or nip 31 between them. The wheels 28 and 29 are both connected to a wheel drive motor 32 arranged to rotate the wheels 28 and 29 in respective opposite directions at predetermined speeds as instructed by the control system 5 so that the rotation of the wheels 28 and 29 tends to pull a roulette ball 100 into and through the nip 31. The wheel drive motor 32 is connected to the wheels 28 and 29 through a drive mechanism which rotates the two wheels 28 and 29 at the same speed.

The speed at which the roulette ball 100 will be fired out from between the two rotating wheels 28 and 29 will depend upon the speeds of rotation of the wheels 28 and 29.

The wheels 28 and 29 are resiliently mounted and the wheel drive motor 32 is arranged to drive the wheels 28 and 29 through a flexible coupling.

In some embodiments the wheels 28 and 29 and wheel drive motor 32 may be connected through a variable drive mechanism, such as a gearbox. In alternative embodiments each of the wheels 28 and 29 may be driven by a respective separate drive motor. In such alternative embodiments both the wheels 28 and 29 and their respective drive motors may be resiliently mounted.

When the wheels 28 and 29 are driven to rotate by the motor 32 and a roulette ball 100 is fed into the nip 31, the roulette ball 100 is pulled through the nip 31 and is fired out from between the two wheels 28 and 29. Although the nip 31 is smaller than the diameter of the roulette ball 100, because the wheels 28 and 29 are resiliently mounted they are able to move to allow the roulette ball 100 to pass between them.

In alternative embodiments one or both of the wheels 28 and 29 may be rigidly mounted and one or both of the wheels 28 and 29 may be formed of resilient material. In such embodiments the resilience of the, or each, wheel 28 and 29 will allow the roulette ball 100 to pass between them and through the nip 31. In some alternative embodiments the wheels 28 and 29 may be both resiliently mounted and comprise a resilient material.

The wheels 28 and 29 comprise a material having a high friction coefficient in order to efficiently accelerate the roulette ball 100. In some examples the wheels 28 and 29 may comprise rubber, latex, or foam silicon. In some examples the wheels 28 and 29 may have a composite structure with at least an outer rim of the wheels being formed of the high friction coefficient material.

Similarly to the previous illustrated embodiments the ball launching mechanism 10 further comprises a ball magazine 63 in which the roulette ball 100 is retained before the roulette ball 100 is launched. The ball magazine 63 comprises a ball release valve 64 and optionally comprises a ball sensor 65. In some alternative embodiments the ball magazine 63 and ball release valve 54 may be absent.

After being fired out from between the wheels 28 and 29 the roulette ball 100 leaves the ball accelerator unit 26 and into the ball spinning unit 27.

The ball spinning unit 27 comprises a ball guide tube 33 and a rotatable wheel 34 driven by a drive motor 35. The wheel 34 is resiliently, or spring, mounted and projects into the ball guide tube 33 so that the gap between the wheel 34 and an inner guide surface of the ball guide tube 33 is less than the diameter of a roulette ball 100, so that a roulette ball 100 passing along the ball guide tube 33 will contact the wheel 34. The wheel 34 is connected to a wheel drive motor 35 arranged to rotate the wheel 34 in a predetermined direction at predetermined speeds as instructed by the control system 5 so that contact between a roulette ball 100 moving along the ball guide tube 33 and the wheel 34 may impart a spin to the roulette ball 100.

The direction and speed of the spin applied to the roulette ball 100 will depend upon the speed of the roulette ball 100 and the speed of rotation of the wheel 34. Accordingly, the direction and speed of the spin applied to the roulette ball 100 can be controlled by the control system 5 appropriately setting the speed of rotation of the wheels 28 and 29 and the direction and speed of rotation of the wheel 34.

In general, contact with the wheel 34 will impart spin to a roulette ball 100. However, if the speed of rotation of the wheel 34 is matched to the speed of the roulette ball 100, the roulette ball 100 may be launched without any spin, if desired.

In the illustrated embodiment the wheel drive motor 35 is directly connected to the wheel 34 and the motor 35 and wheel 34 are resiliently mounted. In an alternative embodiment the wheel drive motor 35 may be arranged to drive the wheel 34 through a flexible coupling, and only the wheel 34 may be resiliently mounted. In some embodiments the wheel 34 and wheel drive motor 35 may be connected through a variable drive mechanism, such as a gearbox.

In alternative embodiments the wheel 34 may be rigidly mounted and the wheel 34 may be formed of resilient material. In such embodiments the resilience of the wheel 34 will allow the roulette ball 100 to pass between the wheel 34 and the inner surface of the ball guide tube 33.

In some alternative embodiments the wheel 34 may be both resiliently mounted and comprise a resilient material.

The wheel 34 comprises a material having a high friction coefficient in order for the wheel 34 to efficiently apply spin to the roulette ball 100. In some embodiments the wheel 34 may comprise rubber, latex, or foam silicon. In some embodiments the wheel 34 may have a composite structure with at least an outer rim of the wheel being formed of the high friction coefficient material.

In this embodiment the speed at which the roulette ball 100 will leave the ball spinning unit 25, and the speed at which roulette ball 100 will be launched into the wheel bowl 9, will depend upon the speed at which the roulette ball is launched by the ball accelerator unit 26 and the change in the speed of the roulette ball 100 caused by contact with the wheel 34. These speeds can be controlled by the control system 5 selecting appropriate speeds and directions of rotation for the wheels 28, 29 and 34. For any specific instance of ball launch, the speed at which the roulette ball 100 will be launched into the wheel bowl 9 will usually be slower than the speed at which the roulette ball 100 leaves the ball spinning unit 25, due to frictional losses. However, there will be a consistent relationship between these two speeds.

In the illustrated embodiment of the ball spinning unit 27 the rotatable wheel 34 is driven. In an alternative embodiment of the ball spinning unit the rotatable wheel 34 is free to rotate, but is not driven.

In this alternative embodiment, when a roulette ball 100 contacts the wheel 34, the non-driven wheel 34 will rotate as a result of frictional forces acting between the roulette ball 100 and the wheel 34. Contact with the wheel 34 will impart spin to a roulette ball 100. The direction of the spin applied to the roulette ball 100 will depend upon the position of the wheel 34, and the speed of the spin will depend upon the speed of the roulette ball 100 and the amount of drag, that is frictional resistance to rotation, of the non-driven wheel 34.

In this alternative embodiment the speed of the roulette ball 100 and the speed of the spin applied to the roulette ball 100 by the ball spinning unit may be related so that the values of these operating parameters cannot be independently selected by the control system 5. However, the control system 5 may still be able to select sufficient different random values of these related operating parameters that the difficulty of predicting the outcome of a game of roulette is maintained.

In a further alternative embodiment in which the wheel 34 is not driven, the drag of the non-driven wheel 34 may be varied to different predetermined values under the control of the control system 5. In some such embodiments the drag of the non-driven wheel 34 may be varied by applying a brake to the non-driven wheel 34 with different predetermined amounts of force. This may allow the relationship between the speed of launch and spin speed of the roulette ball 100 to be varied, and so increase the difficulty of predicting the outcome of a game of roulette.

In some embodiments the ball guide may not be a tube. In such embodiments alternative guide structures such as rails or channels may be used.

In the illustrated embodiment the roulette ball 100 travels directly from the ball accelerator unit 26 to the ball spinning unit 27. In some alternative embodiments the roulette ball 100 may travel between the ball accelerator unit 26 and the ball spinning unit 27 along a connecting ball guide.

The ball, accelerator unit 26 may be supplied with a roulette ball 100 from a ball magazine in a similar manner to the previous embodiment.

Figure 19:
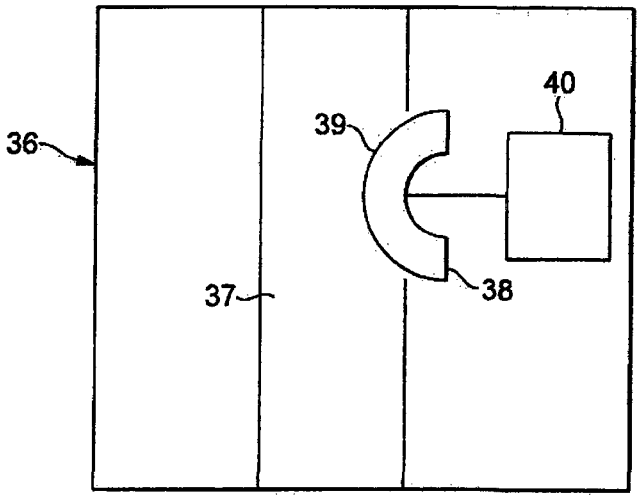
FIG. 19 shows a schematic view of a sixth embodiment of a ball launcher of the roulette wheel apparatus of FIG. 1.

FIG. 19 shows a sixth alternative embodiment of the ball launching mechanism 10.

FIG. 19 shows only a ball spinning unit 36 of the ball launching mechanism 10, the other parts of the ball launching mechanism may be the same as in the previous embodiments.

In FIG. 19 the ball spinning unit 36 comprises a ball guide tube 37 and a friction element 38 having a friction surface 39 moveable by a servo motor 40. The friction element 38 can be selectively moved by the servo motor 40 so that the friction surface 39 does not project into the ball guide tube 37, or projects into the ball guide tube 37 by predetermined amounts. Accordingly, the gap between the friction surface 39 and an inner guide surface of the ball guide tube 37 can be arranged to have different preselected values including values both greater than and less than the diameter of a roulette ball 100. As a result, a roulette ball 100 passing along the ball guide tube 37 can be arranged to not contact the friction surface 39 or to undergo a predetermined amount of contact with the friction surface 39.

The servo motor 40 is arranged to move the friction member 38 to predetermined positions as instructed by the control system 5 so that the predetermined degree of contact between a roulette ball 100 moving along the ball guide tube 37 and the friction surface 39 may impart a spin at a desired speed to the roulette ball 100.

The speed of the spin applied to the roulette ball 100 will depend upon the speed of the roulette ball 100 and the degree of contact of the roulette ball 100 with the friction surface 39. Accordingly, the speed of the spin applied to the roulette ball 100 can be controlled to a desired value by the control system 5 appropriately setting the position of the friction member 38, taking into account the speed of rotation of the wheels 28 and 29.

In general, any contact with the friction surface 39 will impart spin to a roulette ball 100. The control system 5 can control the position of the friction member 38 so that the friction surface 38 is in a position where it does not project into the path of the roulette ball 100 along the ball guide tube 37 if it is desired to launch the roulette ball 100 without any spin.

The friction surface 39 comprises a material having a high friction coefficient in order for the friction surface 39 to efficiently apply spin to the roulette ball 100. In some embodiments the friction surface 39 may comprise rubber, latex, or foam silicon. In some embodiments the friction member 38 may have a composite structure with at least an outer part of the friction member 38 providing the friction surface 39 being formed of the high friction coefficient material.

In the illustrated embodiment the speed at which the roulette ball 100 will leave the ball spinning unit 36, and the speed at which roulette ball 100 will be launched into the wheel bowl 9, will depend upon the speed at which the roulette ball is launched by the ball accelerator unit 26 and the change in the speed of the roulette ball 100 caused by contact with the friction surface 39. These speeds can be controlled by the control system 5 selecting appropriate speeds and directions of rotation for the wheels 28 and 29, and an appropriate position for the friction member 38.

In some embodiments the ball guide may not be a tube. In such embodiments alternative guide structures such as rails or channels may be used.

The illustrated embodiments include ball launcher arrangements having a separate ball accelerator unit and ball spinning unit. In alternative embodiments the number of units may be increased. For example the ball launcher could comprise a plurality of ball accelerator units arranged to successively accelerate the roulette ball. Alternatively, or additionally, the ball launcher could comprise a plurality of ball spinning units arranged to be able to spin the roulette ball at successively increasing speeds, or about different axes of rotation, or to spin balls accelerated in different directions.

In embodiments where a plurality of ball spinning units are arranged to be able to spin the roulette ball about different axes of rotation, these ball spinning units may be arranged at different orientations around a guide or track followed by the roulette ball.

In alternative embodiments having a separate ball accelerator unit, or units, and ball spinning unit, alternative forms of ball accelerator unit may be used.

In some alternative embodiments a pressure operated ball accelerator may be used to accelerate a roulette ball using compressed or pressurised air, or other gas. In some such embodiments the pressure operated ball accelerator may be able to accelerate a roulette ball to a predetermined speed instructed by the control system 5. In some such embodiments this speed may be controlled by varying the air pressure applied to the roulette ball and/or the length of time for which the pressure is applied.

The illustrated embodiments include a ball accelerator unit 26 able to accelerate a roulette ball 100 and a ball launcher 11 able to both accelerate and spin a roulette ball 100 which operate using a pair of spaced apart rotating wheels.

In the illustrated embodiments the pair of spaced apart wheels rotate about respective parallel axes of rotation. This is not essential. In alternative embodiments these axes of rotation may be non-parallel.

Figure 20:
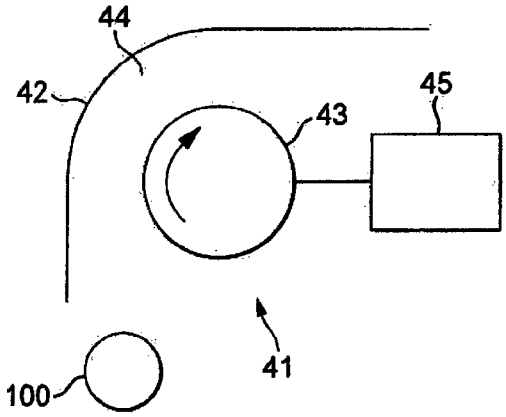
FIG. 20 shows a schematic view of a seventh embodiment of a ball launcher of the roulette wheel apparatus of FIG. 1.

FIG. 20 shows a seventh alternative embodiment of the ball launching mechanism 10.

FIG. 20 shows only a ball launcher 41 of the ball launching mechanism 10, the other parts of the ball launching mechanism 10 may be the same as in the previous embodiments.

As shown in FIG. 20, the ball launcher 41 comprises an arcuate surface 42 and a wheel 43 arranged for rotation and spaced apart form the arcuate surface 42. The wheel 43 is resiliently, or spring, mounted and is separated from the surface 42 by a distance slightly smaller than the diameter of a roulette ball 100 so that the surface 42 and wheel 43 mutually define a gap or nip 44 between them. The wheel 43 is connected to a wheel drive motor 45 arranged to rotate the wheel 43 at predetermined speeds as instructed by the control system 5 so that the rotation of the wheel 43 tends to pull a roulette ball 100 into and through the nip 44.

In the illustrated embodiment the wheel drive motor 45 is directly connected to the wheel 43 and the motor 45 and wheel 43 are resiliently mounted. In an alternative embodiment the wheel drive motor 45 may be arranged to drive the wheel 43 through a flexible coupling, and only the wheel 43 may be resiliently mounted.

In some embodiments the wheel 43 and wheel drive motor 45 may be connected through a variable drive mechanism, such as a gearbox.

When the wheel 43 is driven to rotate by the motor 45 and a roulette ball 100 is fed into the nip 44 defined between the rotating wheel 43 and the arcuate surface 42, the roulette ball 100 is pulled through the nip 44 and is fired out. Although the nip 44 is smaller than the diameter of the roulette ball 100, because the wheel 43 is resiliently mounted it is able to move to allow the roulette ball 100 to pass between the arcuate surface 42 and the wheel 43.

The roulette ball 100 is fired out of the nip 44 at a predetermined speed and with a predetermined spin. The direction of the spin will depend on the positions of the arcuate surface 42 and the wheel 43, and the speed of the spin will depend upon the speed of rotation of the rotating wheel 43.

Thus, the speed and speed of spin of the launched roulette ball 100 will depend upon the rotation speed of the wheel 34. The speed of the spin will also depend upon the degree of friction between the roulette ball 100 and the arcuate surface 42 and wheel 43, which in turn depends on their surface properties of the materials from which they are formed. Usually, these factors will be fixed during operation of the roulette wheel apparatus 1.

In this alternative embodiment the speed of launch and spin speed of the roulette ball 100 may be related so that the values of these operating parameters cannot be independently selected by the control system 5. However, the control system 5 may still be able to select sufficient different random values of these related operating parameters that the difficulty of predicting the outcome of a game of roulette is maintained.

In alternative embodiments the arcuate surface 42 may also be resiliently mounted.

In alternative embodiments the wheel 43 may be rigidly mounted and may be formed of resilient material. In such embodiments the resilience of the wheel 43 will allow the roulette ball 100 to pass between the arcuate surface 42 and the wheel 43 and through the nip 44.

In some alternative embodiments the wheel 43 and/or the arcuate surface 42 may be both resiliently mounted and comprise a resilient material.

In the illustrated embodiment the arcuate surface 42 is concave and substantially parallel to the outer surface of the wheel 43. In alternative embodiments the separation between the arcuate surface 42 and the wheel 43 may vary.

In some examples that arcuate surface 42 may be replaced by a flat surface, or by a convex surface.

In the illustrated embodiment the wheel 43 comprises a material having a high friction coefficient in order for the rotating wheel 43 to efficiently accelerate and apply spin to the roulette ball 100. In some embodiments the wheel 43 may comprise rubber, latex, or foam silicon. In some embodiments the wheel 43 may have a composite structure with at least an outer rim of the wheel being formed of the high friction coefficient material.

Figure 21:
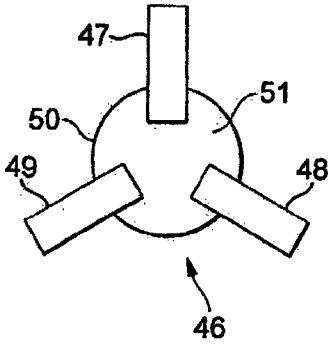
FIG. 21 shows a schematic view of an eighth embodiment of a ball launcher of the roulette wheel apparatus of FIG. 1.

FIG. 21 shows an eighth alternative embodiment of the ball launching mechanism 10.

FIG. 21 shows only a ball launcher 46 of the ball launching mechanism 10, the other parts of the ball launching mechanism 10 may be the same as in the previous embodiments.

As is shown in FIG. 21, the ball launcher 46 according to the eighth embodiment comprises three spaced apart wheels 47 to 49. The wheels 47 to 49 are arranged at equally spaced angular positions around a ball guide 50 defining the path taken by a roulette ball 100, and are arranged for rotation about respective axes of rotation perpendicular and tangential to the path taken by a roulette ball 100 along the ball guide 50. In FIG. 16 the ball launcher 46 is shown "end on" in a view along the ball guide 50.

The wheels 47 to 49 are resiliently, or spring, mounted and are separated so that the wheels 47 to 49 mutually define a gap or nip 51 smaller than the cross sectional area of a roulette ball 100 between them. Similarly to the previous embodiments the wheels 47 to 49 are connected to a wheel drive motor or motors arranged to rotate the wheels 47 to 49 at predetermined speeds as instructed by the control system 5 so that the rotation of the wheels 47 to 49 tends to pull a roulette ball 100 into and through the nip 51.

When the wheels 47 to 49 are driven to rotate and a roulette ball 100 is fed into the nip 51, the roulette ball 100 is pulled through the nip 51 and is fired out from between the three wheels 47 to 49. Although the nip 51 is smaller than the roulette ball 100, because the wheels 47 to 49 are resiliently mounted they are able to move to allow the roulette ball 100 to pass between them.

The speed at which the roulette ball 100 will be fired out from the nip 51 between the three rotating wheels 47 to 49 will depend upon the speeds of rotation of the wheels 47 to 49.

If all of the wheels 47 to 49 are rotating at the same speed the roulette ball 100 will be launched without any spin. Alternatively, by rotating the wheels 47 to 49 at different speeds the roulette ball 100 can be launched with both a speed and an applied spin.

In the ball launcher 46 of the fifth embodiment both the speed of spin of the launched roulette ball 100 and the orientation of the axis about which the roulette ball 100 spins can be selected to be a predetermined value by appropriate selection of the spin speeds of the different wheels 47 to 49. In some examples, some combinations of launch speed and spin direction, speed and axis of the roulette ball may require one or more of the wheels 47 to 49 to be stationary or to have their directions of rotation reversed.

Similarly to the previous embodiments, the speeds, and possibly directions, of rotation of the wheels 47 to 49 may be controlled by the control system 5. The wheels 47 to 49 may be driven by separate motors, or by a common motor through a drive mechanism. The wheels 47 to 49 may be connected to the drive motor or motors through one or more variable drive mechanisms, such as gearboxes.

In some embodiments the wheels 47 to 49 and their drive motors may be resiliently mounted. In alternative embodiments the wheel drive motor or motors may be arranged to drive the wheels 47 to 49 through a flexible coupling or couplings.

In alternative embodiments the wheels 47 to 49 may be rigidly mounted and one or more of the wheels 47 to 49 may be formed of resilient material. In such embodiments the resilience of the, or each, wheel 47 to 49 will allow the roulette ball 100 to pass between them and through the nip 51. In some alternative embodiments the wheels 47 to 49 may be both resiliently mounted and comprise a resilient material.

The wheels 47 to 49 comprise a material having a high friction coefficient in order to efficiently accelerate the roulette ball 100. In some examples the wheels 47 to 49 may comprise rubber, latex, or foam silicon. In some examples the wheels 47 to 49 may have a composite structure with at least an outer rim of the wheels being formed of the high friction coefficient material.

In some embodiments the ball launcher 46 of the eighth embodiment may be arranged to be used as a ball accelerator able to launch a roulette ball at a predetermined speed. In such embodiments it will only be necessary to arrange for the wheels 47 to 49 to all be driven at the same speed.

In some embodiments the ball launcher 46 of the eighth embodiment may be arranged to be used as a ball launcher able to launch a roulette ball at a predetermined speed and also apply a predetermined spin to the roulette ball. In such embodiments it will be necessary to arrange for the wheels 47 to 49 to be drivable at different speeds.

In some embodiments the ball launcher 46 of the eighth embodiment may be arranged to be used as a ball spinning unit able to apply a predetermined spin to a roulette ball. In such embodiments it will be necessary to arrange for the wheels 47 to 49 to be drivable at different speeds.

In the illustrated embodiment the wheels 47 to 49 are the same size. In alternative embodiments the wheels 47 to 49 may have different sizes.

The ball launcher of the eighth embodiment comprises three wheels. In alternative embodiments four or more wheels may be used spaced around the path taken by the roulette ball.

Similarly to the previous embodiments, in embodiments where the ball launcher comprises three or more wheels, one or some of these wheels may be non-driven wheels. Further, in embodiments where one or more wheels are non-driven wheels, one, some, or all of the non-driven wheels may be braked with varying force under the control of the control system 5.

In the embodiments described above the, or each, wheel drive motor may be may be an AC electric motor, or low voltage DC electric motor, a stepper motor, or a compressed air motor. In some embodiments the wheel drive motor(s) may be of the same type as the drive motor 4 for the roulette wheel 2.

The illustrated and described embodiments include different possible configurations for different parts of the roulette wheel assembly, such as the ball launching mechanism and the ball recovery mechanism. These different configurations of different parts in the different embodiments may be combined together in different ways as part of the present invention.

In the illustrated embodiments the ball launching mechanism comprises a single ball launcher, or a single ball launcher and a ball switcher to allow a roulette ball to be launched in either direction. In embodiments where the ball launcher comprises separate means to accelerate the ball and spin the ball, a single ball accelerating means could be used to launch the ball, with a separate ball spinning means being used, one ball spinning means being associated with each of the two routes from the ball launcher to the wheel bowl. In other examples two ball launchers could be provided, and a separate dedicated ball launcher could be used to launch the roulette ball in each direction.

In the illustrated embodiments the roulette ball is accelerated and spun using one or more rotating wheels. The rotating wheels may be replaced with other types of rotating elements, for example rollers, balls or belts. Further, the ball may be accelerated or spun using non-contact means such as air jets or moving magnetic fields.

In the illustrated embodiments ball transport tubes 12 and 13 are used to guide the roulette ball 100 from the ball launcher to the wheel bowl 9. In other embodiments different structures for guiding the roulette ball 100 may be used, such as a track or channel.

In the illustrated embodiments a single ball position sensor 30 is used. In other embodiments multiple ball position sensors may be used. The, or each, ball sensor may be of any known type, for example an optical sensor, or an opto-electrical sensor.

The ball launching mechanism and ball recovery mechanism described above do not have to be used together. In particular, the described ball launcher mechanism may be used with other types of ball recovery mechanisms, including known ball recovery mechanisms. Similarly, the described ball recovery mechanism may be used with other types of ball launcher mechanisms.

In some embodiments a human croupier may manually carry out one, some, or all of the functions of rotating the roulette wheel, identifying where the roulette ball comes to rest, and recovering the roulette ball and returning it to the ball launching mechanism.

In embodiments where the option of operation by a human croupier is not required, the wheel bowl may be covered by a protective structure, such as a transparent dome. Such a protective structure may reduce the ingress of environmental contaminants into the roulette wheel assembly.

The embodiments described above use contact between a member and a roulette ball to apply a controlled amount of spin to a roulette ball. In other embodiments non contact methods may be used to apply a controlled amount of spin to a roulette ball. Examples of suitable non-contact methods include rotating air streams, air streams applied off centre to roulette ball, and in examples where the roulette ball is at least partially formed of magnetic or ferromagnetic material rotating magnetic fields.

The above description relates to a ball launcher used in a roulette wheel apparatus. The ball launcher may also be used in other applications where it is desirable to launch a ball with a predetermined variable speed and/or speed of rotation.

It should be understood that the above description is illustrative and is not intended to be limiting. The combination of features from different embodiments and examples not explicitly described may be carried out, as will be apparent to those skilled in the art from the above description. The scope of the invention is not limited to the described embodiments and examples, and is defined by the claims.

What is claimed is:

1. A roulette wheel apparatus comprising:

a rotatable roulette wheel located in a wheel bowl;

a ball launcher comprising a plurality of rotatable elements configured to launch a roulette ball into the wheel bowl and impart a variable spin, a variable speed, and a variable direction of rotation around the wheel bowl onto the roulette ball;

a first ball magazine located on a first side of the plurality of rotatable elements;

a second ball magazine located on a second side of the plurality of rotatable elements, wherein the second side is opposite the first side;

a first curvilinear guide tube located on the first side of the plurality of rotatable elements;

a second curvilinear guide tube located on the second side of the plurality of rotatable elements, wherein each of the first and second curvilinear guide tubes is configured to direct the roulette ball into an opposite direction of rotation about the wheel bowl; and a control device configured to:

selectively release the roulette ball from the first ball magazine and rotate the plurality of rotatable elements in first directions of rotation to launch the roulette ball into the second curvilinear guide tube; or selectively release the roulette ball from the second ball magazine and rotate the plurality of rotatable elements in second directions of rotation to launch the roulette ball into the first curvilinear guide tube.

2. The roulette wheel apparatus according to claim 1, wherein the plurality of rotatable elements accelerate the roulette ball in contact with the plurality of rotatable elements by mutual friction between the roulette ball and the plurality of rotatable elements.

3. The roulette wheel apparatus according to claim 1, wherein the roulette wheel apparatus varies the variable speed of the roulette ball between different games of roulette.

4. The roulette wheel apparatus according to claim 3, wherein the roulette wheel apparatus varies the variable speed of the roulette ball according to at least one of a predetermined sequence, randomly, or pseudo-randomly.

5. The roulette wheel apparatus according to claim 3, wherein the roulette wheel apparatus varies the variable speed of the roulette ball by varying a speed of rotation of the plurality of rotatable elements.

6. The roulette wheel apparatus according to claim 1, the plurality of rotatable elements defining a gap between them and arranged to accelerate the roulette ball passing through the gap.

7. The roulette wheel apparatus according to claim 1, wherein the variable spin of the roulette ball comprises a variable speed of rotation of the roulette ball about an axis of rotation within the roulette ball.

8. The roulette wheel apparatus according to claim 7, wherein the plurality of rotatable elements spin the roulette ball in contact with the plurality of rotatable elements by mutual friction between the roulette ball and the plurality of rotatable elements.

9. The roulette wheel apparatus according to claim 1, wherein the variable spin of the roulette ball comprises a variable direction of rotation about an axis of rotation within the roulette ball.

10. The roulette wheel apparatus according to claim 3, wherein the variable speed may be varied continuously across a range of launch speeds.

11. The roulette wheel apparatus according to claim 3, wherein the variable speed may be varied to be one of a plurality of discrete possible launch speeds.

12. The roulette wheel apparatus according to claim 1, wherein each of the plurality of rotatable elements comprises a rotating wheel.

13. The roulette wheel apparatus according to claim 1, wherein the roulette wheel comprises a plurality of compartments, and the apparatus further comprises a ball return mechanism arranged to return the roulette ball from one of the plurality of compartments to the ball launcher.

14. The roulette wheel apparatus according to claim 13, wherein the apparatus further comprises a detector arranged to detect which of the plurality of compartments contains the roulette ball.

15. The roulette wheel apparatus according to claim 1, wherein the plurality of rotatable elements of the ball launcher comprises two rotatable elements defining a gap between them smaller than a diameter of the roulette ball.

16. The roulette wheel apparatus according to claim 1, wherein the plurality of rotatable elements of the ball launcher comprises three or more rotatable elements defining a gap between them smaller than a cross section of the roulette ball.

17. The roulette wheel apparatus according to claim 16, wherein the three or more rotatable elements are arranged equally spaced around the gap.

18. The roulette wheel apparatus according to claim 16, wherein the ball launcher launches the roulette ball into the wheel bowl with a launch spin about a predetermined spin axis.

19. The roulette wheel according to claim 18, wherein the apparatus varies the predetermined spin axis by varying relative speeds of rotation of different ones of the three or more rotatable elements.

20. The roulette wheel according to claim 18, wherein the apparatus varies the predetermined spin axis by varying relative directions of rotation of different ones of the three or more rotatable elements.

21. The roulette wheel apparatus according to claim 1, further comprising a drive motor to drive the plurality of rotatable elements.

22. The roulette wheel apparatus according to claim 15, wherein the apparatus varies a degree of contact between the plurality of rotatable elements and the roulette ball by laterally moving at least one of the plurality of rotatable elements.

23. The roulette wheel apparatus of claim 1, wherein the control device is further configured to control a direction of rotation of the roulette wheel.

24. The roulette wheel apparatus of claim 1, wherein the control device is further configured to control a speed of rotation of the roulette wheel.

25. The roulette wheel apparatus of claim 1, wherein the first curvilinear guide tube is configured to guide the roulette ball into a clockwise direction of rotation around the wheel bowl, and wherein the second curvilinear guide tube is configured to guide the roulette ball into a counter-clockwise direction of rotation around the wheel bowl.

26. The roulette wheel apparatus of claim 1, wherein the second directions of rotation are opposite to the first directions of rotation.

* * * * *